US007874655B2

(12) United States Patent
Kojima et al.

(10) Patent No.: US 7,874,655 B2
(45) Date of Patent: Jan. 25, 2011

(54) LIQUID TRANSPORTING APPARATUS AND PIEZOELECTRIC ACTUATOR

(75) Inventors: Masatomo Kojima, Ichinomiya (JP); Yoshitsugu Morita, Nagoya (JP); Keiji Kura, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 206 days.

(21) Appl. No.: 12/343,152

(22) Filed: Dec. 23, 2008

(65) Prior Publication Data

US 2009/0167823 A1 Jul. 2, 2009

(30) Foreign Application Priority Data

Dec. 28, 2007 (JP) ..... 2007-338957
Apr. 2, 2008 (JP) ..... 2008-095731

(51) Int. Cl.
*B41J 2/045* (2006.01)

(52) U.S. Cl. ..... 347/71; 347/72

(58) Field of Classification Search ..... 347/72
See application file for complete search history.

(56) References Cited

U.S. PATENT DOCUMENTS 4,584,590 A 4/1986 Fischbeck et al.
7,198,359 B2 4/2007 Iwao
2006/0268075 A1 11/2006 Sugahara et al.
2007/0046736 A1 3/2007 Katayama et al.

FOREIGN PATENT DOCUMENTS

EP 0 718 900 6/1996
EP 1 372 199 12/2003
JP 2000-127378 5/2000
JP 2005-186596 7/2005
JP 2006-327031 12/2006

*Primary Examiner*—Matthew Luu
*Assistant Examiner*—Lisa M Solomon
(74) *Attorney, Agent, or Firm*—Frommer Lawrence & Haug LLP

(57) ABSTRACT

A liquid transporting apparatus includes a channel unit in which liquid transporting channel transporting the liquid is formed, the liquid transporting channel including a pressure chamber; a piezoelectric actuator which is connected to the channel unit, and which applies a pressure to the liquid in the pressure chamber, the piezoelectric actuator having: a piezoelectric layer; a first electrode arranged on a first surface of the piezoelectric layer to face the pressure chamber; a second electrode which is arranged, to face the first electrode, on a second surface of the piezoelectric layer different from the first surface; third electrodes arranged on the piezoelectric layer to sandwich the first electrode in a plan view; and fourth electrodes which are arranged, to face the third electrode, on the piezoelectric layer; a voltage applying mechanism which applies a voltage to the piezoelectric actuator; and a controller which controls the voltage applying mechanism.

16 Claims, 19 Drawing Sheets

LIQUID TRANSPORTING APPARATUS AND PIEZOELECTRIC ACTUATOR

CROSS REFERENCE TO RELATED APPLICATION

The present application claims priorities from Japanese Patent Application No. 2007-338957, filed on Dec. 28, 2007 and Japanese Patent Application No. 2008-095731, filed on Apr. 2, 2008, the disclosures of which are incorporated herein by reference in their entirety.

BACKGROUND OF THE INVENTION

1. Field of the Invention

The present invention relates to a liquid transporting apparatus which transports a liquid, and a piezoelectric actuator.

2. Description of the Related Art

In an ink-jet head described in Japanese Patent Application Laid-open No. 2006-327031, a vibration plate made of a metallic material such as stainless steel is arranged to cover a plurality of pressure chambers, and a piezoelectric layer is formed on an upper surface of the vibration plate, and individual electrodes corresponding to the plurality of pressure chambers are formed on an upper surface of the piezoelectric layer. Moreover, by applying a voltage between the vibration plate as a common electrode and one of the individual electrodes, an electric field is generated at a portion, of the piezoelectric layer, sandwiched between the common electrode and the individual electrode in a thickness direction of the piezoelectric layer, and portions of the vibration plate and the piezoelectric layer which face the pressure chamber are deformed to form a projection toward the pressure chamber. Accordingly, a volume of the pressure chamber is decreased, and a pressure of the ink in the pressure chamber increases and the ink is jetted from a nozzle communicating with the pressure chamber.

Here, at the time of manufacturing the ink-jet head described in Japanese Patent Application Laid-open No. 2006-327031, in a case in which the vibration plate and the piezoelectric layer are joined by a thermosetting adhesive, the vibration plate and the piezoelectric layer are heated. However, in a case in which the vibration plate is formed of a material such as stainless steel having a coefficient of linear expansion greater than a coefficient of linear expansion of a piezoelectric material which forms the piezoelectric layer, when the temperature is returned to a room temperature after heating, there is a compression distortion in a planar direction of the piezoelectric layer due to a difference in the coefficient of linear expansion of the vibration plate and the piezoelectric layer. When such compression distortion occurs in the piezoelectric layer, piezoelectric characteristics are declined, and as described above, an amount of deformation of the vibration plate and the piezoelectric layer becomes small when the voltage is applied between the individual electrode and the common electrode, and an amount of jetting of ink from the nozzle decreases.

SUMMARY OF THE INVENTION

An object of the present invention is to provide a liquid transporting apparatus in which an amount of transporting of a liquid does not decrease due to a compression distortion of a piezoelectric layer, and a piezoelectric actuator of which, piezoelectric characteristics are not declined due to the compression distortion of the piezoelectric layer.

According to a first aspect of the present invention, there is provided a liquid transporting apparatus which transports a liquid, including: a channel unit in which liquid transporting channel transporting the liquid is formed, the liquid transporting channel including a pressure chamber; a piezoelectric actuator which is connected to the channel unit, and which applies a pressure to the liquid in the pressure chamber, the piezoelectric actuator having: a piezoelectric layer; a first electrode which is arranged on a first surface of the piezoelectric layer to face the pressure chamber; a second electrode which is arranged, to face the first electrode, on a second surface of the piezoelectric layer different from the first surface; third electrodes which are arranged on the piezoelectric layer to sandwich the first electrode in a plan view; and fourth electrodes which are arranged, to face the third electrode, on the piezoelectric layer; a voltage applying mechanism which applies a voltage to the piezoelectric actuator; and a controller which controls the voltage applying mechanism, and the channel unit is formed of a material having a coefficient of linear expansion greater than a coefficient of linear expansion of the piezoelectric layer, and the voltage applying mechanism applies the voltage between the first electrode and the second electrode, and between the third electrodes and the fourth electrodes, and the controller controls the voltage applying mechanism so that the voltage applied between the first electrode and the second electrode, and to thereby deform a portion of the piezoelectric layer facing the pressure chamber and to carry out a pressure applying operation to apply a pressure to the liquid in the pressure chamber and that a predetermined constant voltage is applied between the third electrodes and the fourth electrodes during the pressure applying operation.

According to the first aspect of the present invention, since the predetermined constant voltage is applied between the third electrodes and the fourth electrodes during the pressure applying operation, portions, of the piezoelectric layer, facing the third electrodes and the fourth electrodes contract in a planar direction of the piezoelectric layer (direction orthogonal to a thickness direction of the piezoelectric layer), and due to the contraction, a portion of the piezoelectric layer facing the first electrode and the second electrode is pulled toward both side in the planar direction of the piezoelectric layer. Accordingly, the contraction distortion of the portion, of the piezoelectric layer, facing the first electrode and the second electrode is reduced, and it is possible to prevent an amount of deformation of the piezoelectric layer and the vibration plate from becoming small, and to prevent an amount of transporting of the liquid from being decreased. Here, 'plan view' means viewing from the thickness direction of the piezoelectric layer.

The liquid transporting apparatus of the present invention may further include a vibration plate which covers the pressure chambers of the channel unit, and the piezoelectric actuator may be joined to the channel unit via the vibration plate. The vibration plate and the piezoelectric layer may be formed of a same piezoelectric material, or, the vibration plate may be formed of a material having a coefficient of linear expansion greater than the coefficient of linear expansion of the piezoelectric layer.

In the liquid transporting apparatus of the present invention, the piezoelectric layer may be polarized in a thickness direction of the piezoelectric layer.

In the liquid transporting apparatus of the present invention, the pressure chamber may be formed as a plurality of pressure chambers, the first electrode, the second electrode, the third electrodes, and the fourth electrodes may be formed corresponding to each of the pressure chambers; and at least one of the third electrodes and the fourth electrodes may be mutually connected on the piezoelectric layer. In this case, since at least one of the third electrodes and the fourth electrodes are mutually connected on the piezoelectric layer, it is not necessary to provide an external wire to be connected to at least one of the third electrodes and the fourth electrodes for each of the electrodes, and structures of wires to be connected to the third electrodes and the fourth electrodes become simple.

In the liquid transporting apparatus of the present invention, the third electrodes may be arranged to surround the first electrode in the plan view, and the fourth electrodes may be arranged to surround the second electrode in the plan view. In this case, since a portion, of the piezoelectric layer, facing the first electrode and the second electrode is pulled in a plurality of different directions on a surface of the piezoelectric layer, it is possible to reduce sufficiently the compression distortion of the portion of the piezoelectric layer facing the first electrode and the second electrode.

In the liquid transporting apparatus of the present invention, the controller may control the voltage applying mechanism based on an input of a liquid transporting instruction for transporting the liquid in the liquid transporting channel to start applying the constant voltage between the third electrodes and the fourth electrodes. In this case, since the predetermined constant voltage is applied between the third electrodes and the fourth electrodes when the liquid transporting instruction has been input from an outside, it is possible to prevent an occurrence of a defect in the piezoelectric actuator due to the voltage being applied unnecessarily to the third electrodes and the fourth electrodes.

In the liquid transporting apparatus of the present invention, the controller may control the voltage applying mechanism to apply the constant voltage between the third electrodes and the fourth electrodes to thereby make the portion of the piezoelectric layer between the third electrodes and the fourth electrodes contract in a direction orthogonal to the thickness direction of the piezoelectric layer. In this case, a portion of the piezoelectric layer between the first electrode and the second electrode is pulled in a planar direction thereof, and the contraction distortion is reduced.

In the liquid transporting apparatus of the present invention, the third electrodes may be arranged on the first surface of the piezoelectric layer, and the fourth electrodes may be arranged on the second surface of the piezoelectric layer. In this case, when a voltage is applied between the third electrodes and the fourth electrodes, portions, of the piezoelectric layer, sandwiched between the first electrode and the second electrode is pulled assuredly in a planar direction thereof, and the compression distortion in the portion is reduced.

In the liquid transporting apparatus of the present invention, the voltage applying mechanism may always maintain, at a predetermined reference electric potential, one of the first and third electrodes and the second and fourth electrodes, and may change the electric potential of the other of the first and third electrodes and the second and fourth electrodes to apply the voltage between the first electrode and the second electrode and between the third electrodes and the fourth electrodes; and the one of the first and third electrodes and the second and fourth electrodes may be connected to each other on the piezoelectric layer. In this case, a structure of wire to be connected to one of the first and third electrodes and the second and the fourth electrodes becomes easy.

In the liquid transporting apparatus of the present invention, the piezoelectric layer may include a plurality of piezoelectric layers, the piezoelectric layers including a lower piezoelectric layer which is arranged on a side opposite to the pressure chamber with respect to the vibration plate; an intermediate piezoelectric layer which is arranged on the side opposite to the pressure chamber with respect to the lower piezoelectric layer; and an upper piezoelectric layer which is arranged on the side opposite to the pressure chamber with respect to the intermediate piezoelectric layer; the first electrode being arranged between the intermediate piezoelectric layer and the upper piezoelectric layer to face a central portion of the pressure chamber; the second electrode may be arranged on a surface, of the upper piezoelectric layer, not facing the intermediate piezoelectric layer to face the first electrode and the second electrode extends on both sides in a predetermined direction parallel to a planar direction of the piezoelectric layers, so that both end portions of the second electrodes are extended to locations corresponding to outside of the first electrode in a plan view; the third electrodes may be arranged between the lower piezoelectric layer and the intermediate piezoelectric layer to face the end portions of the second electrode which extends to the locations corresponding to the outside of the first electrode respectively; the fourth electrodes may be arranged on a surface, of the lower piezoelectric layer, not facing the intermediate piezoelectric layer to face the third electrodes respectively; and the pressure applying operation may be carried out when the controller controls the voltage applying mechanism to switch the electric potential of the second electrode between a predetermined first electric potential and a predetermined second electric potential different from the first electric potential while maintaining the first and the fourth electrodes at the first electric potential and maintaining the third electrodes at the second electric potential. In this case, since a constant electric potential is applied between the third electrodes and the fourth electrodes during the pressure applying operation, a portion of the piezoelectric layer facing the first electrode and the second electrode is pulled in a planar direction thereof, and the compression distortion of the portion of the piezoelectric layer is reduced.

In the liquid transporting apparatus of the present invention, the piezoelectric layer may include a plurality of piezoelectric layers; and the third electrodes and the fourth electrodes may be alternately arranged, on surfaces of a part of the plurality of piezoelectric layers, in a stacking direction of the piezoelectric layers. In this case, since a compression force of the portions, of the piezoelectric layer, sandwiched between the third electrodes and the fourth electrodes become substantial, a force pulling the portion, of the piezoelectric layer, facing the first electrode and the second electrode in the planar direction thereof becomes substantial, and it is possible to reduce assuredly the compression distortion in the portion of the piezoelectric layer.

According to a second aspect of the present invention, there is provided a piezoelectric actuator including: a vibration plate having a deformable portion which is formed to be deformable; a piezoelectric layer arranged on one surface of the vibration plate; a first electrode which is arranged on a first surface, of the piezoelectric layer, to face the deformable portion; a second electrode which is arranged, to face the first electrode, on a second surface of the piezoelectric layer different from the first surface; third electrodes which are arranged on the piezoelectric layer, at positions at which the third electrodes sandwich the first electrode as seen from a stacking direction of the vibration plate and the piezoelectric layer; and fourth electrodes which are arranged, to face the third electrodes respectively, on the piezoelectric layer, and the vibration plate is formed of a material having a coefficient of linear expansion greater than a coefficient of linear expansion of the piezoelectric layer; and a voltage applied between the first electrode and the second electrode is changed to carry out a deformation operation for deforming a portion of the piezoelectric layer and a portion of the vibration plate which face the deformable portion, and a predetermined constant voltage is applied between the third electrodes and the fourth electrodes during the deformable operation.

In the piezoelectric actuator of the present invention, the piezoelectric layer may be polarized in a thickness direction of the piezoelectric layer. Further, the piezoelectric layer may include a plurality of piezoelectric layers, the third electrodes may be arranged on a surface of one of the piezoelectric layers, and the fourth electrodes may be arranged on a surface, of the piezoelectric layers, different from the surface on which the third electrodes are arranged.

DETAILED DESCRIPTION OF THE PREFERRED EMBODIMENTS

A first embodiment which is an exemplary embodiment of the present invention will be described below.

Figure 1:
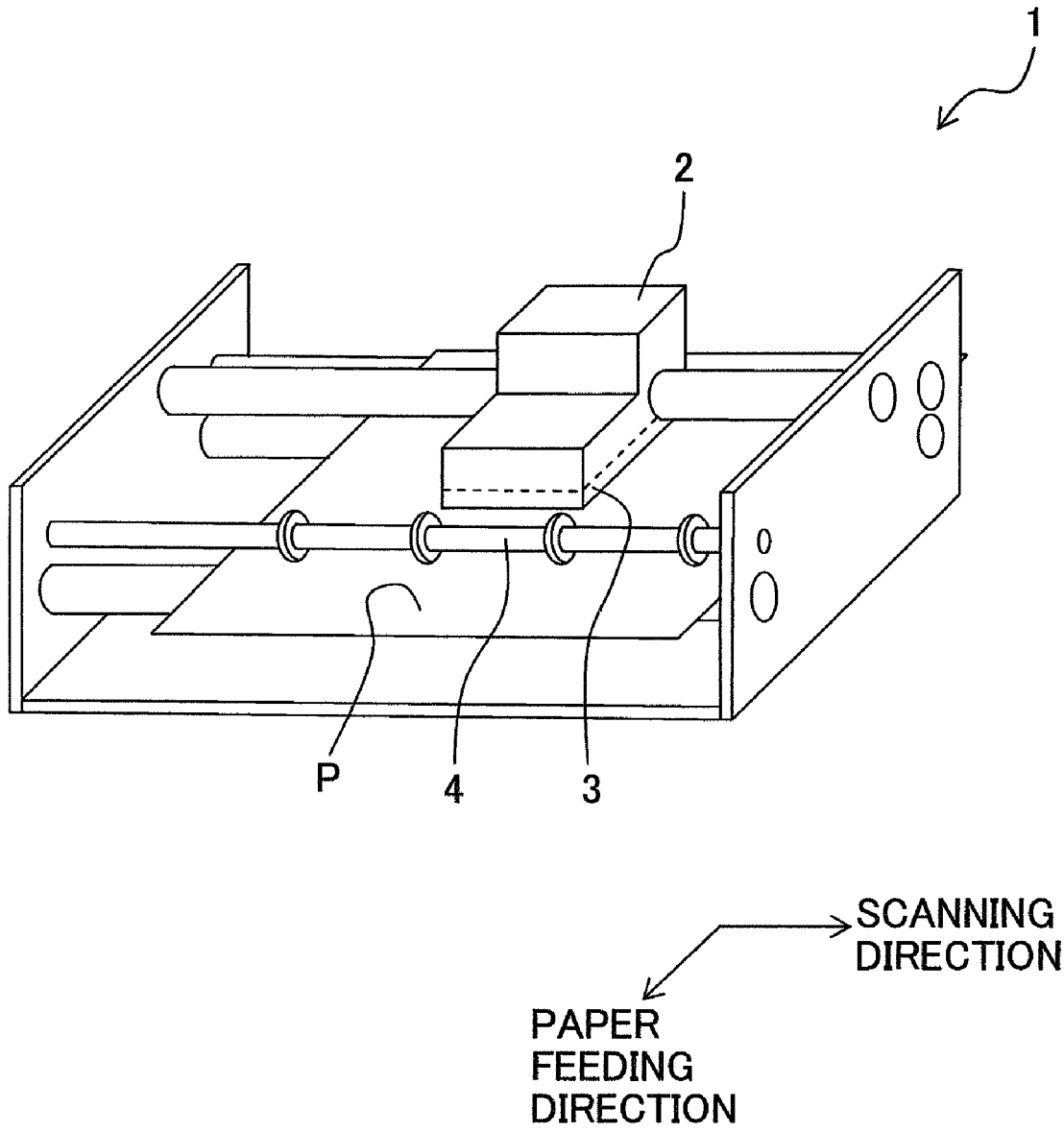
FIG. 1 is a schematic structural view of a printer according to a first embodiment of the present invention.

FIG. 1 is a schematic structural view of a printer according to the first embodiment of the present invention. As shown in FIG. 1, a printer 1 includes a carriage 2, an ink-jet head 3 (liquid transporting apparatus), and a paper transporting roller 4. Moreover, an operation of the printer 1 is controlled by a controller 100 (refer to FIG. 6).

The carriage 2 reciprocates in a left-right direction (scanning direction). The ink-jet head 3 is installed on a lower surface of the carriage 2, and jets an ink from nozzles 15 (refer to FIG. 2) which will be described later. The paper transporting roller 4 transports a recording paper P in a frontward direction in FIG. 1 (paper feeding direction). In the printer 1, printing is carried out on the recording paper P transported in the paper feeding direction by the paper transporting roller 4, by jetting the ink from the nozzles 15 of the ink-jet head 3 (refer to FIG. 4) which reciprocates in the scanning direction with the carriage 2.

Figure 2:
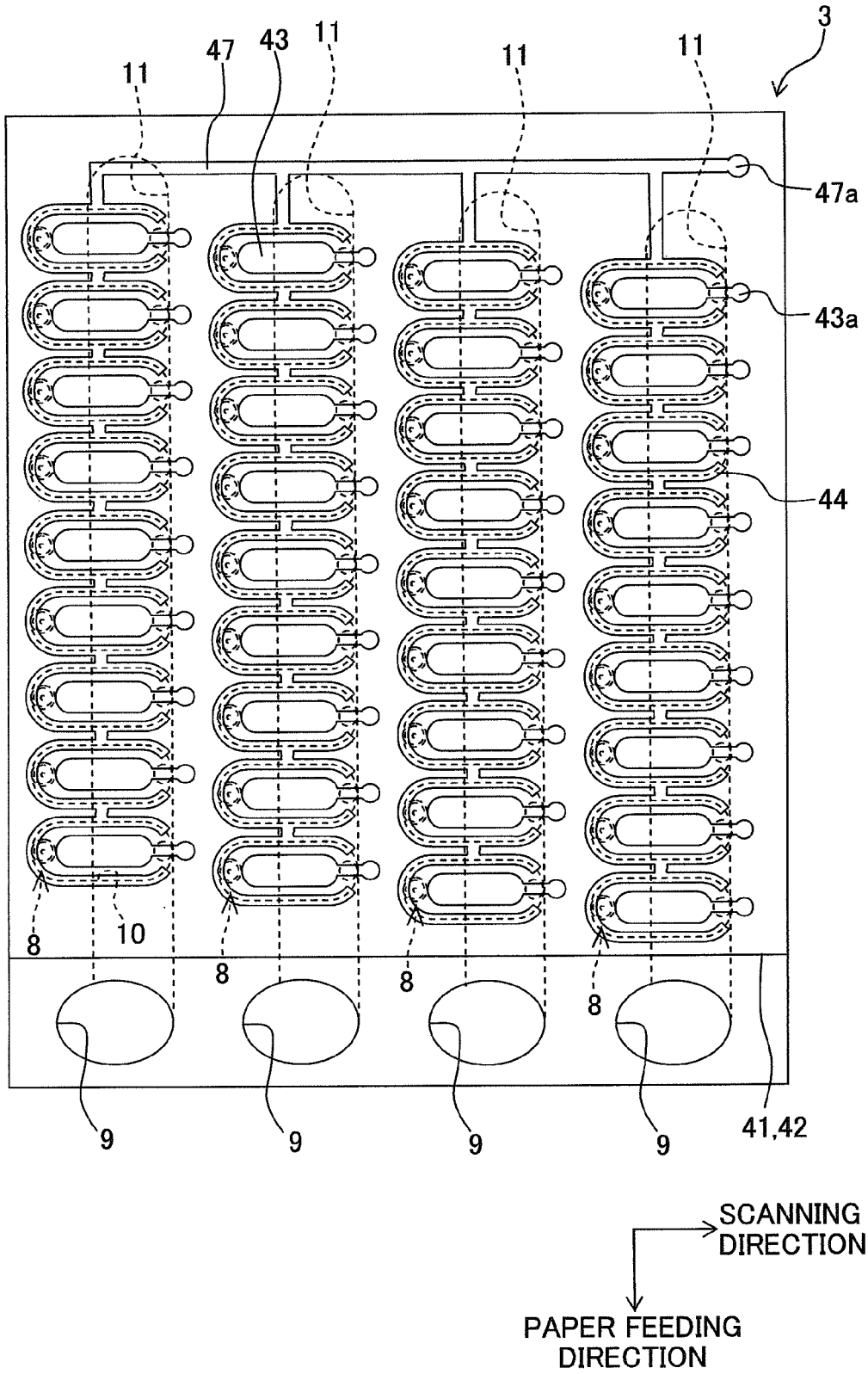
FIG. 2 is a plan view of an ink-jet head in FIG. 1.
Figure 3:
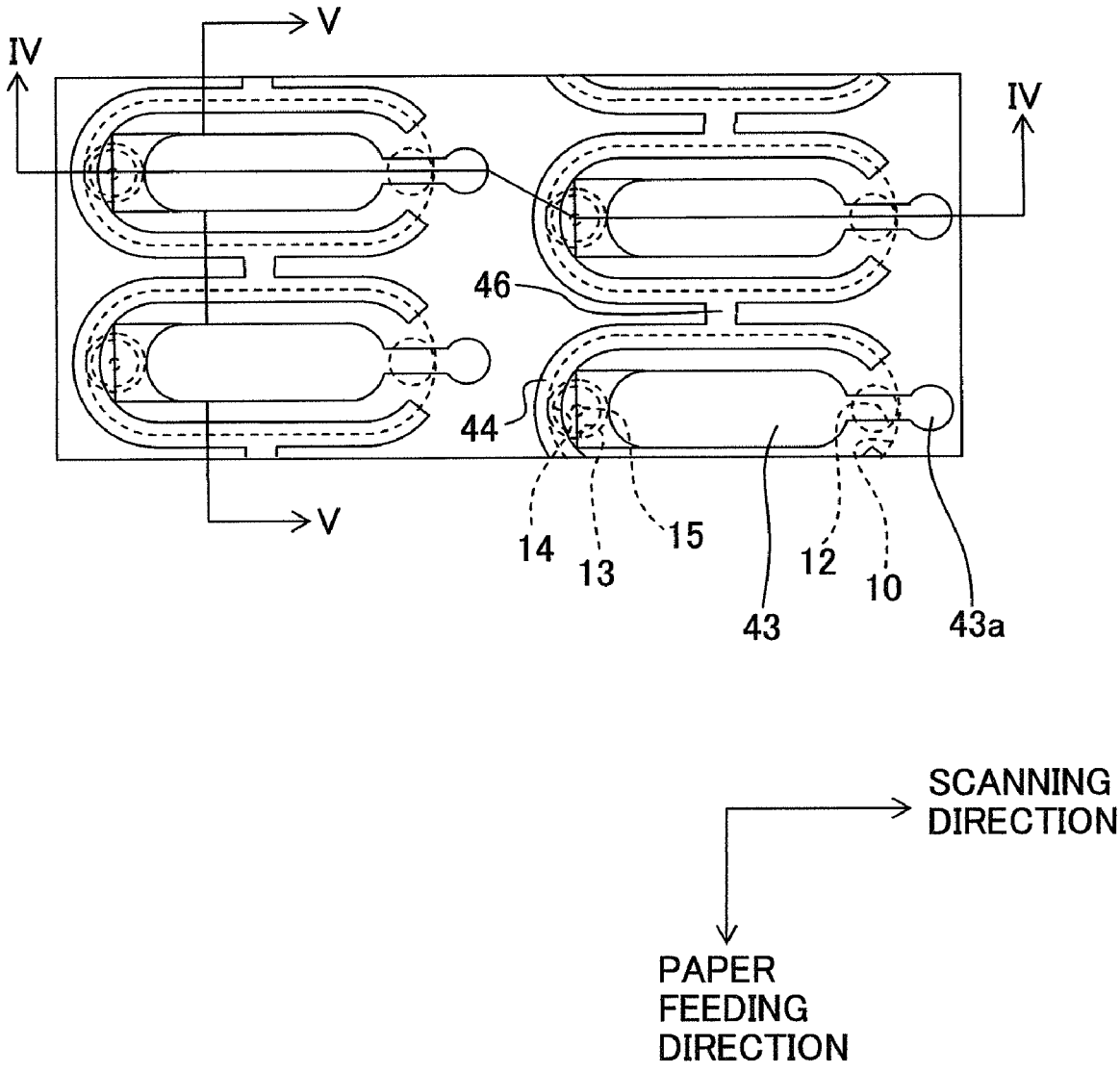
FIG. 3 is a partially enlarged view of FIG. 2.
Figure 4:
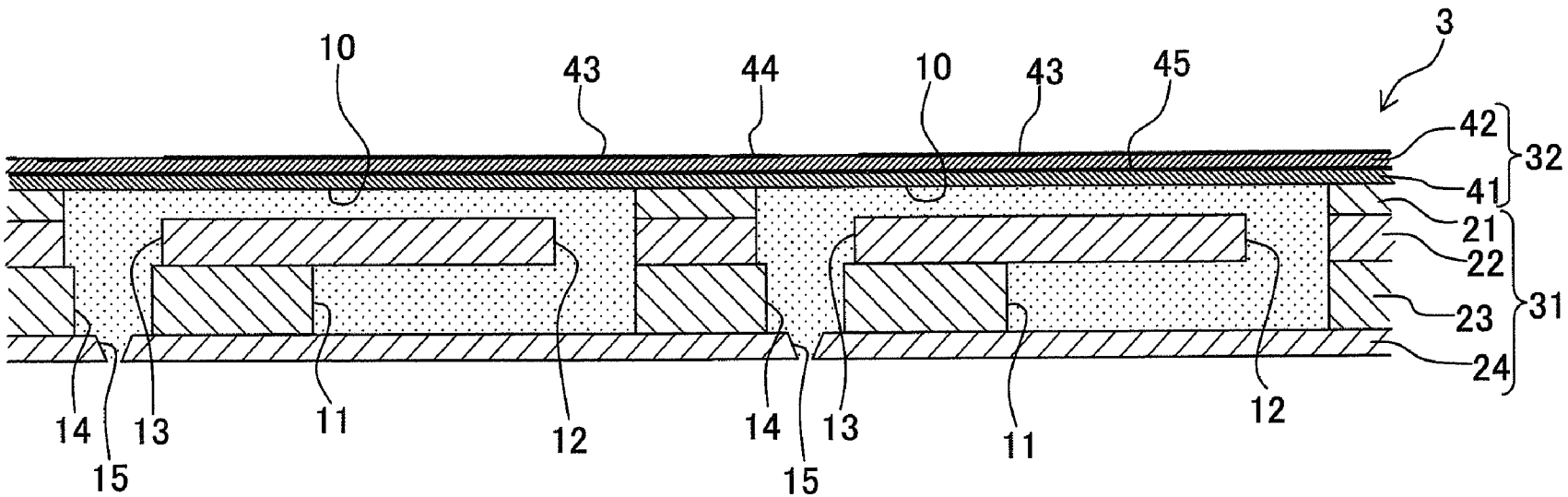
FIG. 4 is a cross-sectional view taken along a line IV-IV in FIG. 3.
Figure 5:
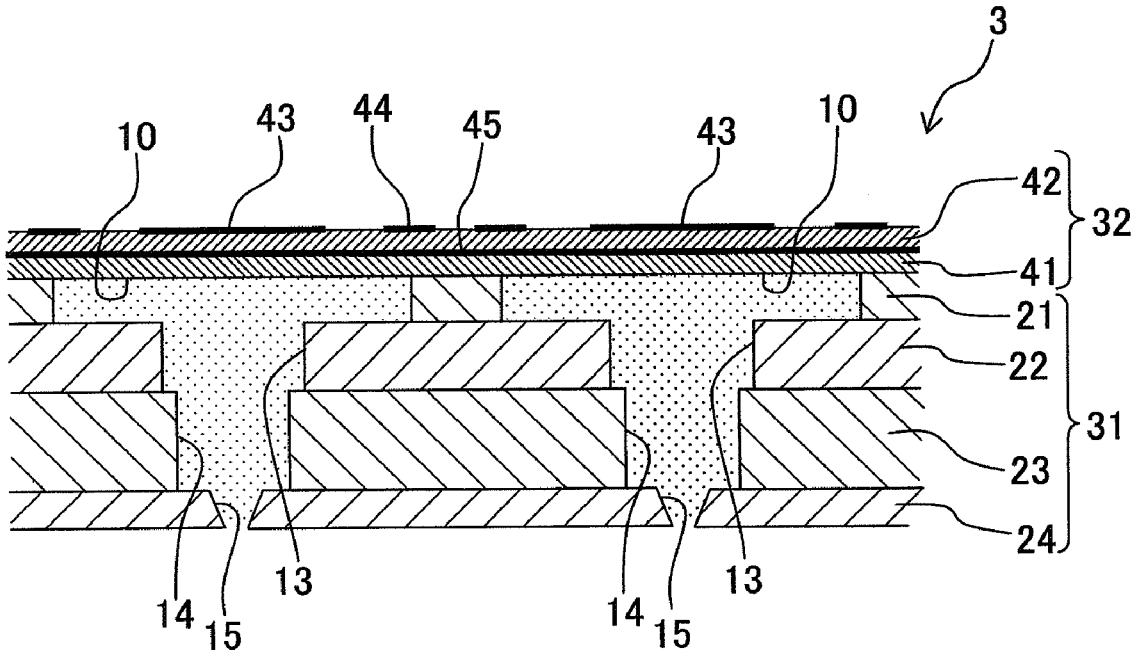
FIG. 5 is a cross-sectional view taken along a line V-V in FIG. 3.

Next, the ink-jet head 3 will be described below. FIG. 2 is a plan view of the ink-jet head 3 in FIG. 1. FIG. 3 is a partially enlarged view of FIG. 2. FIG. 4 is a cross-sectional view taken along a line IV-IV in FIG. 3. FIG. 5 is a cross-sectional view taken along a line V-V in FIG. 3.

As shown in diagrams from FIG. 2 to FIG. 5, the ink-jet head 3 includes a channel unit 31 in which nozzles 15, pressure chambers 10, and a manifold channel 11 which will be described later are formed, and a piezoelectric actuator 32 which is arranged on an upper surface of the channel unit 31.

The channel unit 31 includes in order from an upper side, four plates namely, a cavity plate 21, a base plate 22, a manifold plate 23, and a nozzle plate 24, and these four plates are mutually stacked. Out of these four plates 21 to 24, the three plates 21 to 23 (at least a portion of these plates to be joined to a vibration plate 41 which will be described later) excluding the nozzle plate 24 are made of a metallic material such as stainless steel (for example SUS 43 and SUS 316), which is a material having a coefficient of linear expansion greater than a coefficient of linear expansion of a piezoelectric material which form a piezoelectric layer 42 and the vibration plate 41 which will be described later, and the nozzle plate 24 is formed of a synthetic resin such as polyimide. Or, the nozzle plate 24 may also be formed of a metallic material similarly as the other three plates 21 to 23. The coefficient of linear expansion for the piezoelectric material which forms the piezoelectric layer 42 and the vibration plate 41 which will be described later is about 5.5[$10^{-6}$/° C.], whereas, the coefficients of linear expansions for SUS 430 and SUS 316 are about 10.4 [$10^{-6}$/° C.] and 16.0[$10^{-6}$/° C.] respectively.

A plurality of nozzles 15 is formed in the nozzle plate 24. The nozzles 15 are arranged along a paper feeding direction (vertical direction in FIG. 2) forming nozzle rows 8. Four such nozzle rows 8 are arranged in a scanning direction (left-right direction in FIG. 2). From the nozzles 15 forming four nozzle rows 8, inks of colors namely, black, yellow, cyan, and magenta are jetted in order from the nozzle row 8 on a left side in FIG. 2.

A plurality of pressure chambers 10 corresponding to the nozzles 15 is formed in the cavity plate 21. Each of the pressure chambers 10 has an elliptical shape in a plan view with the scanning direction as a longitudinal direction of the ellipse, and is arranged such that a left end portion of the pressure chamber 10 in a plan view overlaps with the nozzle 15. Through holes 12 and 13 are formed in the base plate 22, at positions overlapping with both end portions in a longitudinal direction of the pressure chamber 10 in a plan view.

Four manifold channels 11 extending in the paper feeding direction, corresponding to the four nozzle rows 8 are formed in the manifold plate 23. Each of the manifold channels 11 overlaps in a plan view with a substantially right half portion of the corresponding pressure chambers 10. An ink supply port 9 is provided at a lower end portion in FIG. 2 of each manifold channel 11, and the ink is supplied to the manifold channel 11 from the ink supply port 9. Moreover, a through hole 14 is formed in the manifold plate 23, at positions overlapping with the through holes 13 and the nozzles 15 in a plan view.

In the channel unit 31, the manifold channel 11 communicates with the pressure chambers 10 via the through holes 12, and the pressure chambers 10 further communicate with the nozzles 15 via the through holes 13 and 14. In this manner, a plurality of individual ink channels from outlets of the manifold channels 11 reaching the nozzles 15 via the pressure chambers 10 is formed in the channel unit 31. Ink channels in which the individual ink channels and the manifold channels 11 are combined correspond to liquid transporting channels according to the present invention.

The piezoelectric actuator 32 has the piezoelectric layer 42, individual electrodes 43, an auxiliary electrodes 44, and a common electrode 45, and is joined to the channel unit 31 via the vibration plate 41. The vibration plate 41 is made of a piezoelectric material having lead zirconium titanate which is a mixed crystal of lead titanate and lead zirconate, as a main constituent. The vibration plate 41 is joined to an upper surface of the channel unit 31 by a thermosetting adhesive, to cover the pressure chambers 10.

The piezoelectric layer 42 is made of a piezoelectric material same as of the vibration plate 41, and is formed continuously spreading over the pressure chambers 10, on an upper surface (one surface on opposite side of the pressure chamber 10) of the vibration plate 41. Moreover, the piezoelectric layer 42 is polarized in advanced in a thickness direction thereof. Here, the piezoelectric layer 42 and the vibration plate 41 described above are formed by stacking a green sheet of a piezoelectric material on which the individual electrodes 43, the auxiliary electrodes 44, and the common electrode 45 are formed, and thereafter baking a stacked body which is formed. At the time of joining the vibration plate 41 to an upper surface of the cavity plate 21, the stacked body of the vibration plate 41 and the piezoelectric layer 42 is joined to the upper surface of the cavity plate 21 by a thermosetting resin.

A plurality of individual electrodes 43 (first electrode) is formed corresponding to the plurality of pressure chambers 10, on an upper surface of the piezoelectric layer 42 (first surface of the piezoelectric layer). Each of the individual electrodes 43, in a plan view, has a substantially elliptical shape slightly larger than the pressure chamber 10, and is arranged to overlap with a substantially central portion of the pressure chamber 10 (at least facing the pressure chamber 10). A substantially right end portion in FIG. 3 of each of the individual electrodes 43 extends up to a position not facing the pressure chamber 10 at left in the diagram, and a front end portion thereof is a connecting terminal 43*a*. The connecting terminal 43*a* is connected to a driver IC 50 (refer to FIG. 6, voltage applying mechanism) which will be described later, via a flexible print circuit (FPC) not shown in the diagram, and the driver IC 50 changes an electric potential of the individual electrodes 43.

Each of the auxiliary electrodes 44 (third electrode) is arranged on the upper surface of the piezoelectric layer 42, surrounding almost the entire periphery, excluding the connecting terminal 43*a*, of one of the individual electrodes 43 (sandwiching at least one of the individual electrodes 43). In a plan view, a substantial half portion of each of the auxiliary electrodes 44, at an inner side in a width direction overlaps with the pressure chamber 10, and a substantial half portion at an outer side overlaps with a wall of the pressure chamber 10. Moreover, the auxiliary electrodes 44 adjacent in the paper feeding direction are connected mutually via a connecting portion 46 which extends in the paper feeding direction between these auxiliary electrodes 44.

Furthermore, four auxiliary electrodes 44 corresponding to the pressure chambers 10 arranged at the uppermost side in FIG. 2, among the pressure chambers 10 corresponding to the nozzles 15 forming each nozzle row 8, are connected mutually by a wire 47 which extends upward in FIG. 2 from these four auxiliary electrodes 44, and extends in the scanning direction at an upper end portion thereof. Accordingly, all the auxiliary electrodes 44 are connected with each other on the upper surface of the piezoelectric layer 42 (on the piezoelectric layer 42).

Moreover, a connecting terminal 47*a* is provided at an upper right end portion in FIG. 2 of the wire 47. The driver IC 50 (refer to FIG. 6) which will be described later is connected to the connecting terminal 47*a* via the FPC which is not shown in the diagram, and the driver IC 50 changes the electric potential of the auxiliary electrodes 44. Here, as it has been described above, since the auxiliary electrodes 44 are connected mutually, by connecting one connecting terminal 47*a* and a wire of the FPC, it is possible to connect the plurality of auxiliary electrodes 44 to the driver IC 50. Accordingly, a structure of wires of the FPC becomes simpler than in a case in which the plurality of auxiliary electrodes 44 and the driver IC 50 are connected separately.

A common electrode 45 is formed continuously spreading over almost an entire area of a lower surface of the piezoelectric layer 42 (a surface of the piezoelectric layer, different from a surface on which the individual electrode 43 and the auxiliary electrodes 44 are formed). The common electrode 45 is connected to the driver IC 50 (refer to FIG. 6) via the FPC at a position not shown in the diagram, and is kept all the time at a ground electric potential (reference electric potential) by the driver IC 50. A portion of the common electrode 45, overlapping with each of the individual electrodes 43 in a plan view (a portion occupying an area facing each of the individual electrodes 43) corresponds to a second electrode according to the present invention, and a portion of the common electrode 45 overlapping with each of the auxiliary electrodes 44 in a plan view (facing each of the auxiliary electrodes 44), and surrounding the second electrode according to the present invention corresponds to fourth electrode according to the present invention. In other words, the common electrode 45 is an electrode in which the second electrode and the fourth electrode according to the present invention are connected with each other on the lower surface of the piezoelectric layer 42 (on the piezoelectric layer 42), and the second electrode and the fourth electrode are arranged on the same surface of the piezoelectric layer 42, and the second electrode and the fourth electrode are connected with each other on the lower surface of the piezoelectric layer 42 (on the piezoelectric layer 42).

The driver IC 50, as it has been described above, by maintaining the common electrode 45 at the ground electric potential, and changing the electric potential of the individual electrodes 43 and the auxiliary electrodes 44, applies a voltage between the individual electrodes 43 and the common electrode 45 (between the first electrode and the second electrode), and between the auxiliary electrode 44 and the common electrode 45 (between the third electrodes and the fourth electrodes).

Figure 6:
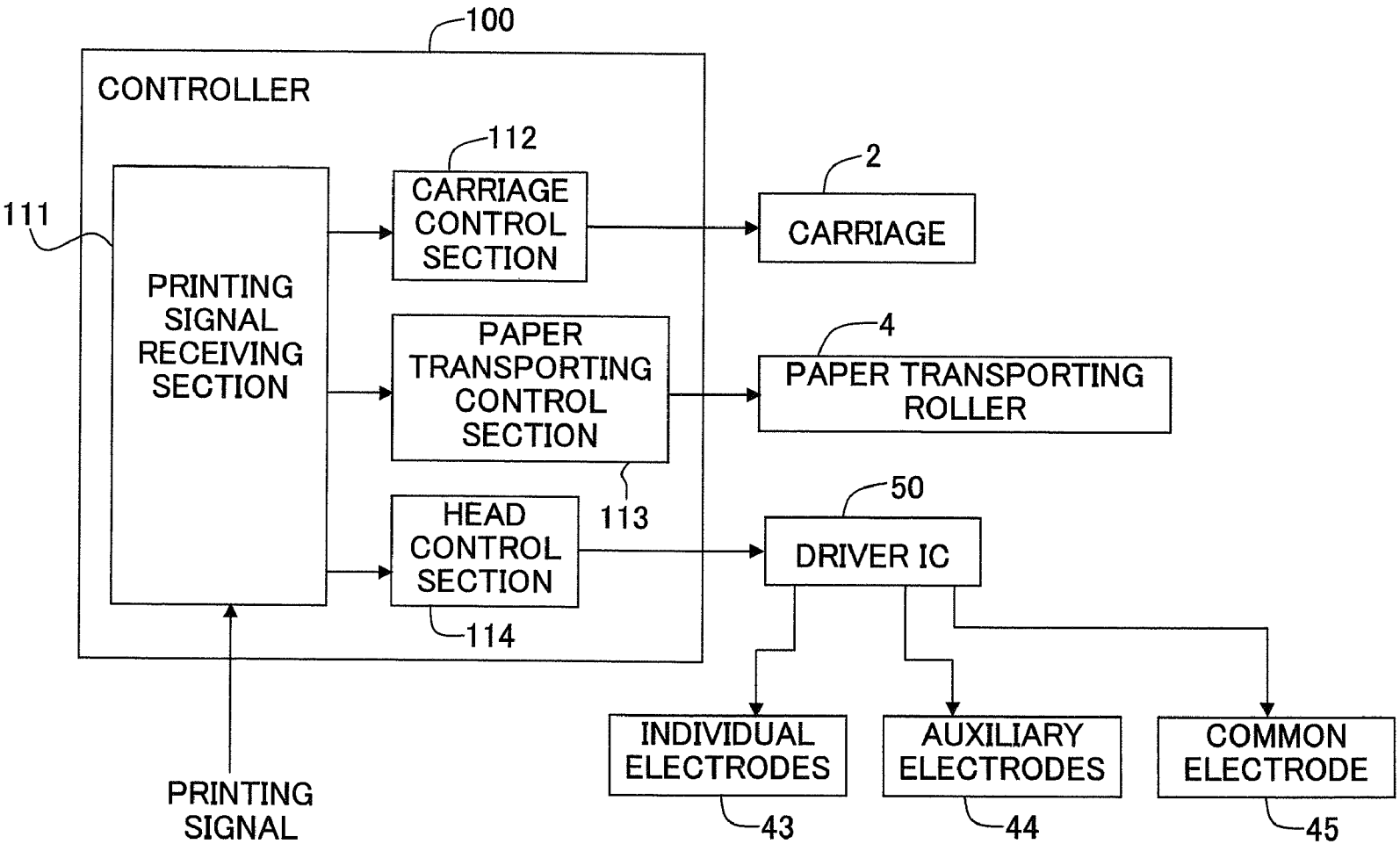
FIG. 6 is a functional block diagram of a controller.

Next, the controller 100 will be described below. FIG. 6 is a functional block diagram of the controller 100. The controller 100 includes a CPU (central processing unit), ROM (read only memory), and a RAM (random access memory), which, as shown in FIG. 6, operate as a printing signal receiving section 111, a carriage control section 112, a paper transporting control section 113, and a head control section 114.

The printing signal receiving section 111 receives a printing signal which is input from an outside by a PC (personal computer) etc. Here, the printing signal is a signal such as a signal of a printing instruction (liquid transporting instruction) which gives an instruction to carry out printing, and a signal of image data carrying out printing. The carriage control section 112 controls an operation of the carriage 2 at the time of carrying out printing. The paper transporting control section 113 controls an operation of the paper transporting roller 4 at the time of carrying out printing. The head control section 114 controls an operation of the driver IC 50 which changes the electric potential of the individual electrodes 43 and the auxiliary electrodes 44, and maintains the common electrode 45 at the ground electric potential.

Figure 7:
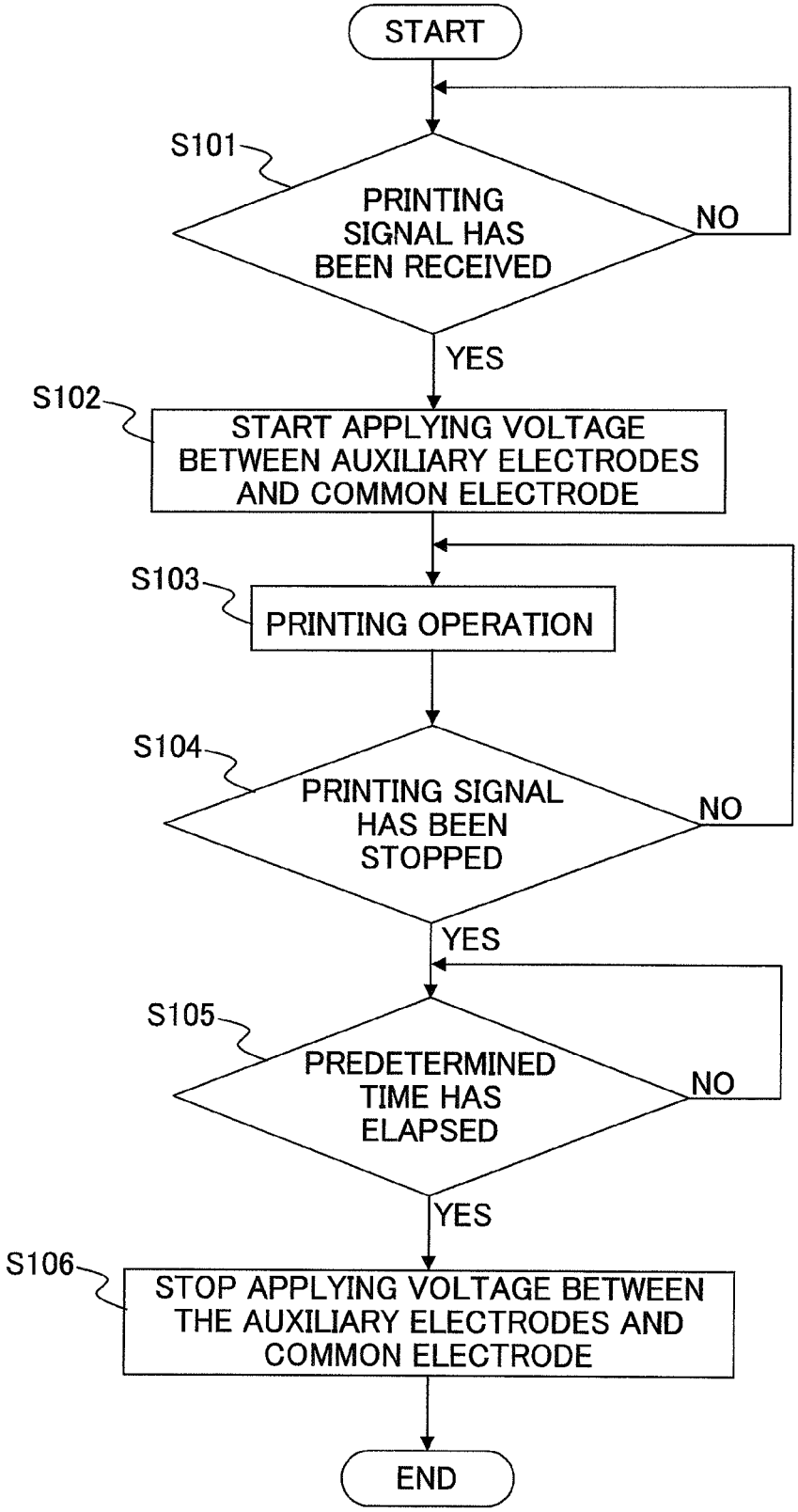
FIG. 7 is a flowchart showing a flow of an operation of the printer.

Next, an operation of the printer 1 will be described below. FIG. 7 is a flowchart showing a flow of the operation of the printer 1.

In the printer 1, the individual electrodes 43, the auxiliary electrodes 44, and the common electrode 45 are kept at the ground electric potential in advance. Moreover, as shown in FIG. 7, the printer 1 is in a stand-by state until the printing signal receiving section 111 receives a printing signal from outside (NO at step S101, hereinafter, 'S101'), and when the printing signal is received (according to an input of a liquid transporting instruction) (YES at step S101), the electric potential of the auxiliary electrodes 44 are changed, and a predetermined constant voltage is applied between the auxiliary electrodes 44 and the common electrode 45 (between the third electrodes and the fourth electrodes) (step S102).

Accordingly, an electric field in the thickness direction is generated in portions, of the piezoelectric layer 42, sandwiched between the auxiliary electrodes 44 and the common electrode 45, and since the direction of the electric field coincides with the polarizing direction of the piezoelectric layer 42, the portions of the piezoelectric layer 42 contract in a planar direction which is orthogonal to the polarization direction (direction orthogonal to the thickness direction). According to the contractions of the portions of the piezoelectric layer 42, a portion, of the piezoelectric layer 42, facing each of the individual electrodes 43 which is arranged at an inner side one of the auxiliary electrodes 44 in a plan view is pulled in all directions parallel to the planar direction of the piezoelectric layer 42, directed outward of the pressure chamber 10 in a plan view (in a plurality of different directions in a plane of the piezoelectric layer 42), and a contraction distortion which will be described later, of the portion of the piezoelectric layer 42, facing the individual electrode 43 is reduced.

After the step S102, a printing operation described below is started (step S103). Or, the printing operation in step S103 may be started at the same time when the constant voltage is applied between the auxiliary electrodes 44 and the common electrode 45 in the step S102.

The printing operation at the step 103 will be described below. In the step S103, according to the printing signal received by the printing signal receiving section 111, the carriage control section 112 and the paper transporting control section 113 control the carriage 2 and the paper transporting roller 4 respectively, and the head control section 114 controls the driver IC 50, to change the electric potential of the individual electrode 43 corresponding to the nozzle 15 which jets the ink, and thereby to apply a voltage between the individual electrode 43 and the common electrode 45.

As the voltage is applied between the individual electrode 43 and the common electrode 45, an electric field in the thickness direction, parallel to the polarization direction of the piezoelectric layer 42 is generated in a portion, of the piezoelectric layer 42, between the individual electrode 43 and the common electrode 45 to which the voltage is applied, and this portion of the piezoelectric layer 42 contracts in the planar direction which is orthogonal to the polarization direction (direction orthogonal to the thickness direction). According to the contraction of this portion of the piezoelectric layer 42, portions of the piezoelectric layer 42 and the vibration plate 41, facing the corresponding pressure chamber 10 are entirely deformed to form a projection toward the pressure chamber 10, and a volume of the pressure chamber 10 is decreased. Accordingly, there is an increase in a pressure of the ink inside the pressure chamber 10, and the ink is jetted from the nozzle 15 communicating with the pressure chamber 10. The operation of applying a pressure on the ink inside the pressure chamber 10 by deforming the portions of the vibration plate 41 and the piezoelectric layer 42, facing the pressure chamber 10, by applying the voltage between the individual electrode 43 and the common electrode 45 corresponds to a pressure applying operation and a deformation operation according to the present invention. Moreover, the portion of the vibration plate 41, facing the pressure chamber 10 which is deformed during the pressure applying operation (deformation operation) corresponds to a deformable portion according to the present invention.

Here, as it has been described above, since the vibration plate 41 and the cavity plate 21 are joined by a thermosetting adhesive, at the time of joining the vibration plate 41 and the cavity plate 21, after applying the thermosetting adhesive, and arranging upon positioning the stacked body of the vibration plate 41 and the piezoelectric layer 42, and the channel unit 31 (cavity plate 21), the heating is carried out. Consequently, after the heating, when the temperature is returned to a room temperature, a contraction distortion in the planar direction occurs in the vibration plate 41 and the piezoelectric layer 42 arranged on the upper surface of the vibration plate 41, due to a difference in the coefficient of linear expansion of the vibration plate 41 and the coefficient of linear expansion of the channel unit 31 (cavity plate 21). Therefore, when the auxiliary electrodes 44 are not provided, piezoelectric characteristics of the piezoelectric layer 42 are declined, and there is a possibility that an amount of deformation of the piezoelectric layer 42 and the vibration plate 41 is small, and therefore an amount of ink jetted from the nozzle is decreased.

However, in the first embodiment, before applying the voltage between the individual electrode 43 and the common electrode 45, the constant voltage is applied between the auxiliary electrodes 44 and the common electrode 45 in the step S102, and as it has been described above, the portion of the piezoelectric layer 42 facing the individual electrode 43 which is arranged at the inner side of the auxiliary electrodes 44 in the plan view is pulled in the planar direction of the piezoelectric layer 42 directed outward of the pressure chamber 10. Therefore, the contraction distortion of the portion of the piezoelectric layer 42 sandwiched between the individual electrode 43 and the common electrode 45 is reduced. Consequently, the amount of deformation of the piezoelectric layer 42 and the vibration plate 41 is prevented from being decreased, and as a result, the amount of the ink jetted from the nozzle 15 is prevented from being decreased.

Furthermore, in the first embodiment, since the auxiliary electrodes 44 are arranged to surround the individual electrode 43, the portion, of the piezoelectric layer 42, facing the individual electrode 43 is pulled in all directions parallel to the planar direction of the piezoelectric layer 42, and it is possible to reduce sufficiently the contraction distortion of the portion of the piezoelectric layer 42, facing the individual electrode 43.

Next, while the printing signal receiving section 111 is receiving the printing signal (NO at step S104), the printing operation is continued in a state in which the voltage is applied between the auxiliary electrodes 44 and the common electrode 45, and after the printing signal is not received by the printing signal receiving section 111 (YES at step S104), the printer 1 waits only for a predetermined time (NO at step S105). When the predetermined time has elapsed (YES at step S105), a judgment that al the jetting of ink to the recording paper P from the ink-jet head 3 has been completed is made, and the electric potential of the auxiliary electrodes 44 is returned to the ground electric potential by the driver IC 50. Accordingly, applying the voltage between the auxiliary electrodes 44 and the common electrode 45 is stopped (step S106), and the operation is terminated.

Here, in the first embodiment, the constant voltage is not applied all the time between the auxiliary electrodes 44 and the common electrode 45. When the printing signal is received by the printing signal receiving section 111, the constant voltage is started to be applied between the auxiliary electrodes 44 and the common electrode 45, and after a predetermined time is elapsed since the printing signal was not received, the applying of the constant voltage between the auxiliary electrodes 44 and the common electrode 45 is stopped. In other words, during the printing operation including the pressure applying operation according to the present invention, the constant voltage is applied continuously between the auxiliary electrodes 44 and the common electrode 45, and when the printing operation is not being carried out, the auxiliary electrodes 44 are kept at the ground electric potential, and no constant voltage is applied between the auxiliary electrodes 44 and the common electrode 45. This is for preventing an occurrence of a defect in the piezoelectric actuator 32 due to the electric potential of the auxiliary electrodes 44 at the time of applying the constant voltage between the auxiliary electrodes 44 and the common electrode 45.

According to the first embodiment described above, by applying the constant voltage between the auxiliary electrodes 44 and the common electrode 45 to contract the portions of the piezoelectric layer 42 sandwiched between the auxiliary electrodes 44 and the common electrode 45 in the planar direction of the piezoelectric layer 42, the portion, of the piezoelectric layer 42, facing the individual electrode 43 arranged at the inner side of the auxiliary electrodes 44 in the plan view is pulled in the planar direction of the piezoelectric layer 42, directed outward of the pressure chamber 10 in a plan view In this state, by applying the voltage between the individual electrode 43 and the common electrode 45 to deform the portions of the piezoelectric layer 42 and the vibration plate 41, facing the pressure chamber 10, the ink is jetted from the nozzle 15. Consequently, at the time of deforming the piezoelectric layer 42 and the vibration plate 41, the contraction distortion, of the portion of the piezoelectric layer 42 sandwiched between the individual electrode 43 and the common electrode 45, which occurs due to the difference in the coefficient of linear expansion of the cavity plate 21 and the coefficient of linear expansion of the vibration plate 41 is reduced, and the amount of deformation of the piezoelectric layer 42 and the vibration plate 41 is prevented from being decreased. Accordingly, it is possible to prevent the amount of jetting of the ink from the nozzle 15 from being decreased.

Furthermore, since each of the auxiliary electrodes 44 is arranged to surround one of the individual electrodes 43, the portion of the piezoelectric layer 42 facing the individual electrode 43 is pulled in all directions parallel to the planar direction of the piezoelectric layer 42. Accordingly, it is possible to reduce sufficiently the contraction distortion of the portion of the piezoelectric layer 42 facing the individual electrode 43.

Moreover, since the plurality of auxiliary electrodes 44 are connected with each other, it is possible to connect the plurality of auxiliary electrodes 44 and the FPC at one location, and a wiring structure of the FPC becomes simple as compared to a case in which the plurality of auxiliary electrodes are connected separately to the FPC.

Moreover, since it is possible to form the second electrodes and the fourth electrodes according to the present invention by forming the common electrode 45 on almost the entire area of the lower surface of the piezoelectric layer 42, it is possible to form the second electrodes and the fourth electrodes easily.

Moreover, only at the time of the printing operation, the constant voltage is applied between the auxiliary electrodes 44 and the common electrode 45 by changing the electric potential of the auxiliary electrodes 44, and when the printing operation is not being carried out, by keeping the auxiliary electrodes 44 at the ground electric potential, it is possible to prevent an occurrence of a defect in the piezoelectric actuator 32 due to the electric potential of the auxiliary electrodes 44.

Next, modified embodiments in which various modifications are made in the first embodiment will be described below. However, same reference numerals are assigned to components which are similar as in the first embodiment, and repeated description of such components is omitted.

Figure 8:
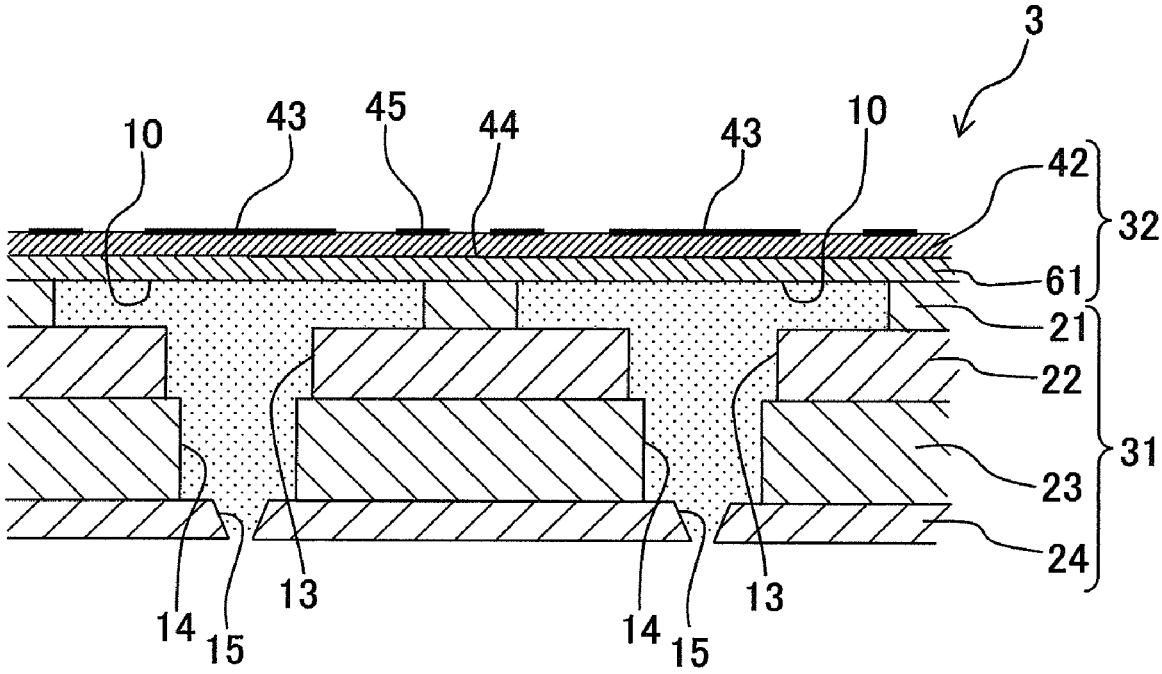
FIG. 8 is a diagram of a first modified embodiment, corresponding to FIG. 5.

In the first modified embodiment, as shown in FIG. 8, a vibration plate 61 is formed of an electroconductive material having a coefficient of linear expansion greater than the coefficient of linear expansion of the piezoelectric layer 42, such as stainless steel (for example, SUS 430, SUS 316), and the vibration plate 61 and the piezoelectric layer 42 are joined by a thermosetting adhesive. Moreover, the vibration plate 61 made of the electroconductive material also serves as a common electrode (second electrodes and fourth electrodes), and is kept at the ground electric potential all the time.

Even in this case, when the temperature is returned to the room temperature after heating the vibration plate 61 and the piezoelectric layer 42 to join the vibration plate 61 and the piezoelectric layer 42, a contraction distortion, in the planar direction of the piezoelectric layer 42, occurs in the piezoelectric layer 42 due to the difference in the coefficient of linear expansion of the vibration plate 61 and the coefficient of linear expansion of the piezoelectric layer 42. Accordingly, piezoelectric characteristics of portions of the piezoelectric layer 42 facing the individual electrodes 43 are declined. However, even in this case, by applying a constant voltage between the auxiliary electrodes 44 and the vibration plate 61 before carrying out the printing operation, portions of the piezoelectric layer 42 sandwiched between the auxiliary electrodes 44 and the vibration plate 61 contract, and due to the contractions of the portions of the piezoelectric layer 42, the portion of the piezoelectric layer 42 facing each of the individual electrodes 43 is pulled in the planar direction of the piezoelectric layer 42 directed outward the pressure chamber 10, and the contraction distortion of the piezoelectric layer 42 in this portion is reduced.

Figure 9:
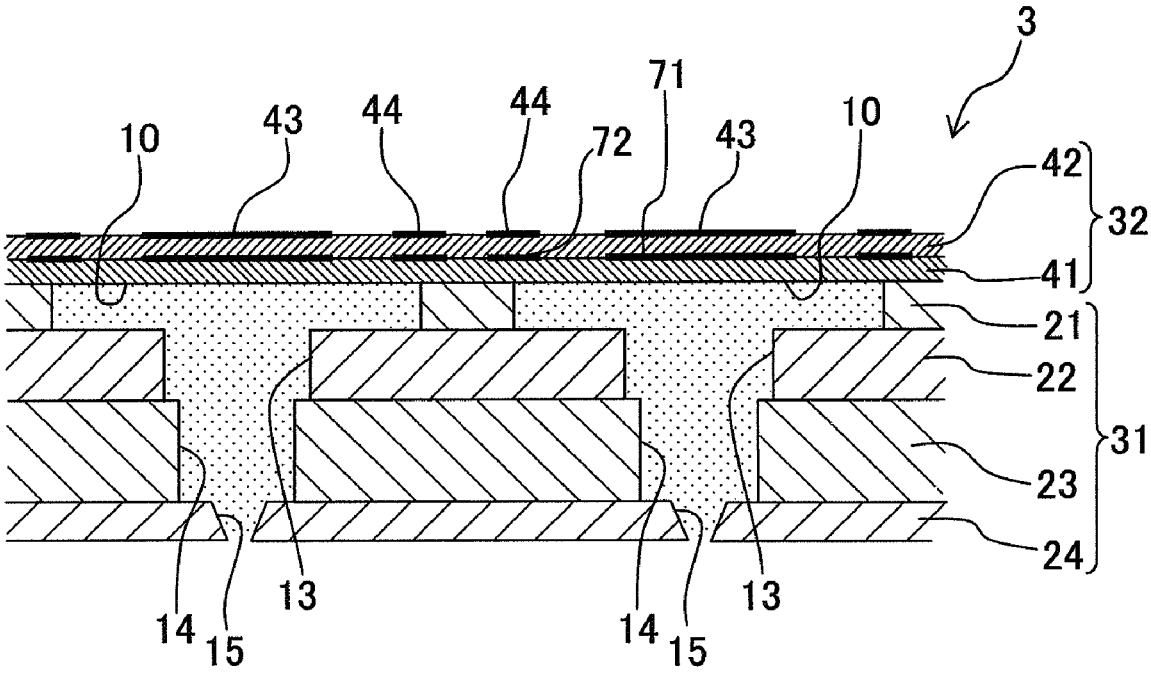
FIG. 9 is a diagram of a second modified embodiment, corresponding to FIG. 5.

In a second modified embodiment, as shown in FIG. 9, electrodes 71 (second electrodes) are formed in areas on the lower surface of the piezoelectric layer 42, facing the individual electrodes 43 respectively, and electrodes 72 (fourth electrodes) are formed in areas on the lower surface of the piezoelectric layer 42, facing the auxiliary electrodes 44 respectively.

In this case, by applying a voltage between one of the individual electrodes 43 and one of the electrodes 71, similarly as in the case in the first embodiment to deform the portions of the piezoelectric layer 42 and the vibration plate 41 facing the pressure chamber 10, it is possible to make the ink to be jetted from the nozzle 15. Moreover, by applying a constant voltage between the auxiliary electrodes 44 and the electrodes 72, similarly as in the first embodiment, the portions of the piezoelectric layer 42 sandwiched between the auxiliary electrodes 44 and the electrodes 72 are contracted. According to the contraction of the portions of the piezoelectric layer 42, the portion of the piezoelectric layer 42, facing each of the individual electrodes 43 is pulled in the planar direction of the piezoelectric layer 42 directed outward of the pressure chamber 10, and the contraction distortion in this portion of the piezoelectric layer 42 is reduced.

In the case of the second modified embodiment, the electrodes 71 may be connected with each other and the electrodes 72 may be connected with each other, or the electrodes 71 may not be connected with each other and the electrodes 72 may not be connected with each other. Furthermore, when the electrodes 71 are not connected with each other and the electrodes 72 are not connected with each other, contrary to the first embodiment, the individual electrodes 43 may be kept at the ground electric potential, and the voltage may be applied between the individual electrodes 43 and the electrodes 71 by changing an electric potential of the electrodes 71, and the auxiliary electrodes 44 may be kept at the ground electric potential, and the voltage may be applied between the auxiliary electrodes 44 and the electrodes 72 by changing an electric potential of the electrodes 72.

Moreover, in a case of maintaining the individual electrodes 43 at the ground electric potential, the individual electrodes 43 may be connected with each other on the piezoelectric layer 42, and furthermore, in a case of maintaining both the individual electrodes 43 and the auxiliary electrodes 44 at the ground electric potential, the individual electrodes 43 and the auxiliary electrodes 44 may be connected with each other on the piezoelectric layer 42. In this case, a wiring of the FPC to be connected to the individual electrodes 43 and the auxiliary electrodes 44 becomes simple.

Figure 10:
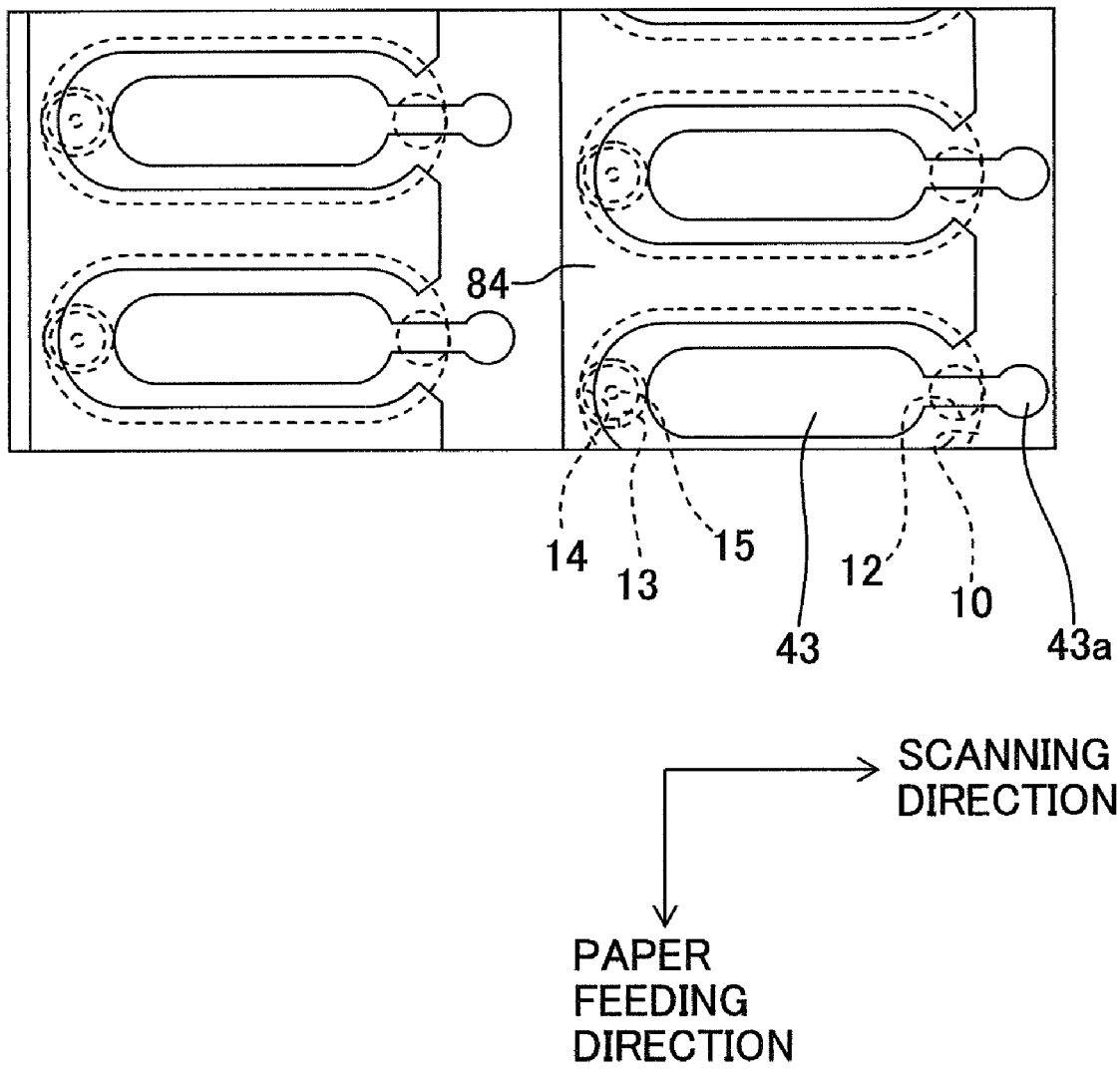
FIG. 10 is a diagram of a third modified embodiment, corresponding to FIG. 3.

In a third modified embodiment, as shown in FIG. 10, an electrode 84 arranged to spread over almost an entire area between the adjacent pressure chambers 10 in the paper feeding direction, in addition to the areas surrounding the individual electrodes 43 in a plan view, on the upper surface of the piezoelectric layer 42. The electrode 84 in the third modified embodiment is an electrode formed by a plurality of third electrodes according to the present invention being connected mutually, and is an integrated body.

In this case, since the electrode 84 is arranged to spread over almost the entire area between the adjacent pressure chambers 10 in the paper feeding direction, when a voltage is applied between the electrode 84 and the common electrode 45, the piezoelectric layer 42 contracts in the planar direction of the piezoelectric layer 42 over a wide range, and due to the contraction of the piezoelectric layer 42, the portion of the piezoelectric layer 42, facing each of the individual electrodes 43 is pulled substantially in the planar direction of the piezoelectric layer 42 directed outward of the pressure chambers 10. Consequently, even when the difference in the coefficient of linear expansion of the vibration plate 41 and the piezoelectric layer 42 is substantial and the contraction distortion occurring in the piezoelectric layer 42 is substantial, it is possible to reduce sufficiently the contraction distortion in the portion of the piezoelectric layer 42, facing the individual electrode 43.

Figure 11:
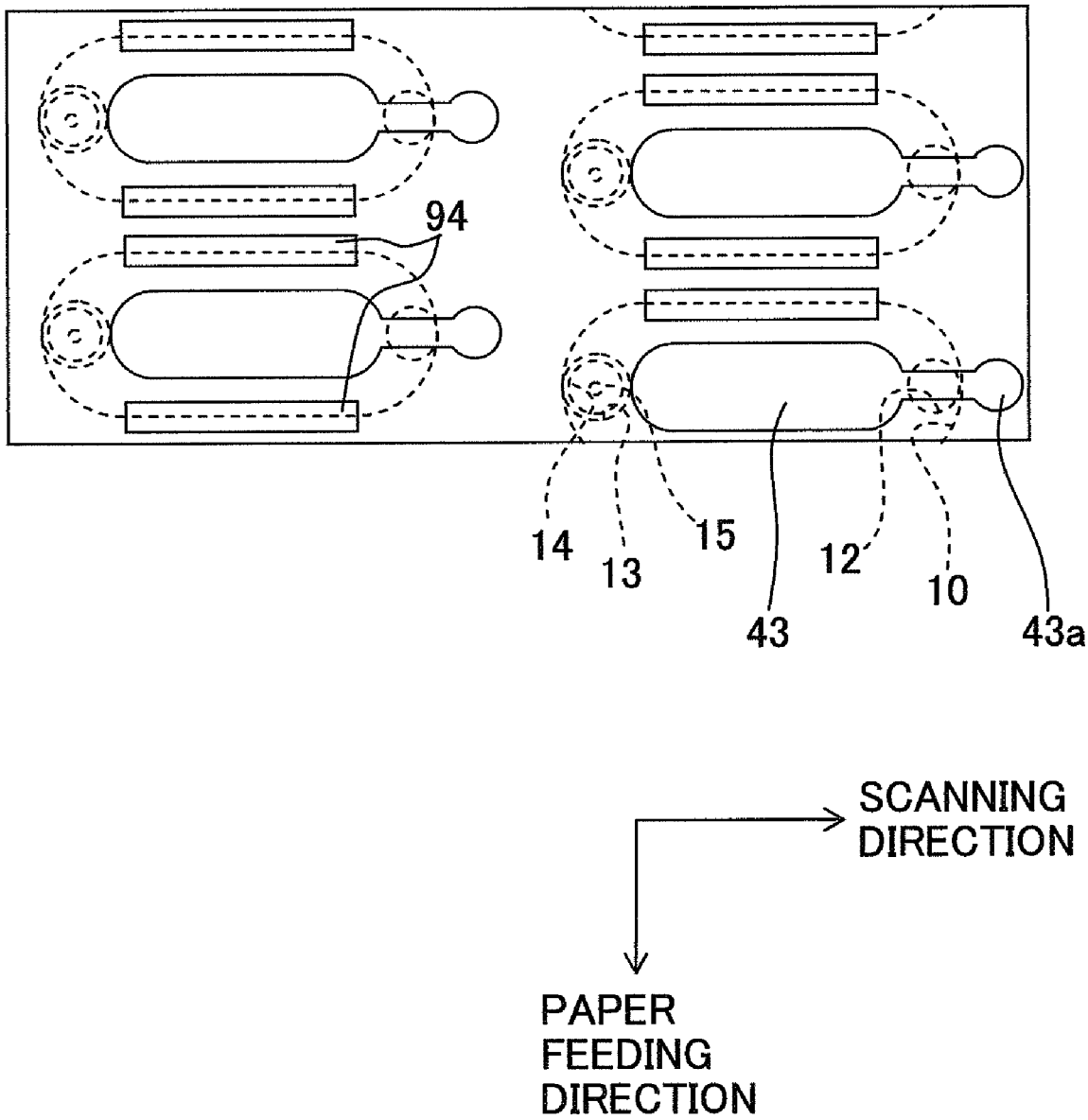
FIG. 11 is a diagram of a fourth modified embodiment, corresponding to FIG. 3.

In the first embodiment, the auxiliary electrodes 44 are arranged to surround the individual electrode 43. However, the arrangement of the auxiliary electrodes 44 is not restricted to this. In a fourth modified embodiment, as shown in FIG. 11, auxiliary electrodes 94 are arranged at both sides in the paper feeding direction, of the individual electrode 43. In other words, the auxiliary electrodes 94 are arranged to sandwich each of the individual electrodes 43 in a plan view.

Even in this case, by applying a voltage between the auxiliary electrodes 94 and the common electrode 45, portions of the piezoelectric layer 42, sandwiched between the auxiliary electrodes 94 and the common electrode 45 contract, and due to the contraction of the portions of the piezoelectric layer 42, the portion of the piezoelectric layer 42, facing each of the individual electrodes 43 sandwiched between the auxiliary electrodes 94 is pulled toward both sides in the paper feeding direction (in the planar direction of the piezoelectric layer 42), and the contraction distortion of the portion of the piezoelectric layer 42, facing each of the individual electrodes 43 is reduced.

In the first embodiment, the auxiliary electrodes 44 are connected mutually via the connecting portion 46 and the wire 47. However, the auxiliary electrodes 44 may not be connected mutually, and may be connected to the driver IC 50 separately.

In the first embodiment, the voltage has been applied between the auxiliary electrodes 44 and the common electrode 45 only during the printing operation at step S103 (refer to FIG. 7). However, the voltage may be applied all the time between the auxiliary electrodes 44 and the common electrode 45, while a power supply of the printer 1 is ON, and not only during the printing operation.

Moreover, in the first embodiment, out of the four plates 21 to 24, the cavity plate 21, the base plate 22, and the manifold plate 23 are formed of stainless steel. However, at least the cavity 21 which is joined to the vibration plate 41 may be formed of a material having a coefficient of linear expansion greater than the coefficient of linear expansion of the piezoelectric material, such as stainless steel.

Furthermore, as in the case in the first modified embodiment, when the vibration plate 61 is formed of a material having the coefficient of linear expansion greater than the coefficient of linear expansion of the piezoelectric material such as stainless steel, all the plates 21 to 24 forming the channel unit 31 may be made of a material such as a synthetic resin material.

Moreover, in the first embodiment, the substantially half portion on the inner side in a direction of width of each of the auxiliary electrodes 44 in a plan view overlaps with one of the pressure chambers 10, and the half portion on the outer side thereof overlaps with a wall which defines the pressure chambers 10. However, without restricting to such arrangement, each of the auxiliary electrodes 44 may entirely overlap with one of the pressure chambers 10 in a plan view, or each of the auxiliary electrodes 44 may entirely face the wall which defines the pressure chambers 10 in a plan view.

In a case in which each of the auxiliary electrodes 44 entirely overlaps with the pressure chamber 10, since there is no portion which is fixed to the channel unit 31 in the piezoelectric layer 42 sandwiched between the auxiliary electrode 44 and the common electrode 45, the portions of the piezoelectric layer 42 facing the individual electrodes 43 are pulled substantially by the contraction of the portion, of the piezoelectric layer 42, sandwiched between the auxiliary electrode and the common electrode 45. Accordingly, the contraction distortion of the portion, of the piezoelectric layer 42, facing the individual electrode 43 is reduced substantially. However, in this case, when areas of the auxiliary electrodes are excessively large, since portions occupied by the auxiliary electrodes out of the portion, on the upper surface of the piezoelectric layer 42, facing the pressure chamber 10 increase, an area of each of the individual electrodes 43 is decreased by that much amount, and as a result, an amount of deformation of the vibration plate 41 and the piezoelectric layer 42 when the voltage is applied between the individual electrode 43 and the common electrode 45 becomes small.

On the other hand, in a case in which each of the auxiliary electrodes entirely overlaps with the wall which defines the pressure chamber 10, since each of the auxiliary electrodes is not arranged on the portion, of the upper surface of the piezoelectric layer 42, facing the pressure chamber 10, each of the individual electrodes 43 does not become small. However, in this case, since the portion, of the piezoelectric layer 42, sandwiched between one of the auxiliary electrodes and the common electrode 45 is fixed to the channel unit 31 (cavity plate 21), the contraction amount of the portion, of the piezoelectric layer 42, sandwiched between the auxiliary electrode 44 and the common electrode 45 becomes small when a constant voltage is applied between the auxiliary electrode and the common electrode 45. Accordingly, an amount in which the portion, of the piezoelectric layer 42, facing the individual electrode 43 is pulled becomes small. Consequently, when the areas of the auxiliary electrodes are small, it is not possible to achieve sufficiently an effect of reduction of the contraction distortion of the piezoelectric layer 42.

Moreover, in the first embodiment, only one piezoelectric layer 42 is provided, and both the individual electrodes 43 and the auxiliary electrodes 44 are arranged on the upper surface of the piezoelectric layer 42. The common electrode 45 in which the second electrode and the fourth electrode according to the preset invention are integrated is arranged between the piezoelectric layer 42 and the vibration plate 41. However, the arrangement is not restricted to such arrangement. A plurality of mutually stacked piezoelectric layers may be provided, and the first electrodes and the third electrodes may be arranged on mutually different surfaces of the plurality of piezoelectric layers. Or, the second electrodes and the fourth electrodes may be arranged on mutually different surfaces of the plurality of these piezoelectric layers.

Even in this case, due to the contraction of a portion of the piezoelectric layer sandwiched between each of the third electrodes and one of the fourth electrodes, in a planar direction of the piezoelectric layer by applying a constant voltage between the third electrode and the fourth electrode, portions of the plurality of piezoelectric layers each facing the pressure chamber 10 and including the portion sandwiched between each of the first electrodes and one of the second electrodes, are pulled toward the outer side of one of the pressure chamber 10, in the planar direction thereof. Accordingly, the contraction distortion of the portion of the piezoelectric layer sandwiched between the first electrode and the second electrode is reduced, and an amount of deformation of the portion of the piezoelectric layer sandwiched between the first electrode and the second electrode is suppressed from becoming small, when the piezoelectric actuator is driven by changing the voltage between the first electrode and the second electrode.

Next, a second embodiment according to the present invention will be described below. However, since in the second embodiment, only a structure of the ink-jet head differs from the structure of the ink-jet head in the first embodiment, only this portion in which the structure differs will be described below, and the description of the structures which are similar as in the first embodiment will be omitted.

Figure 12:
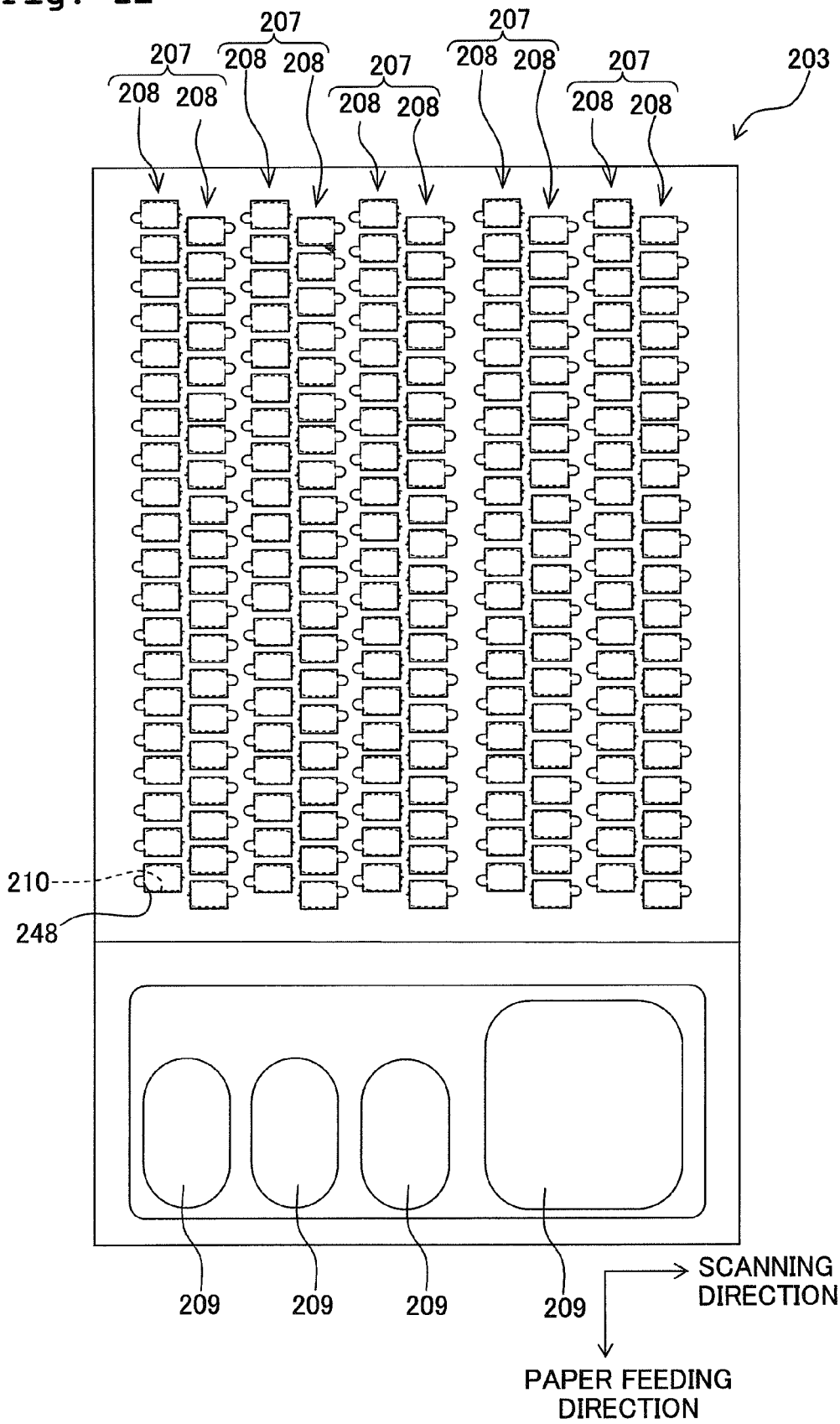
FIG. 12 is a plan view of an ink-jet head according to a second embodiment of the present invention.
Figure 13:
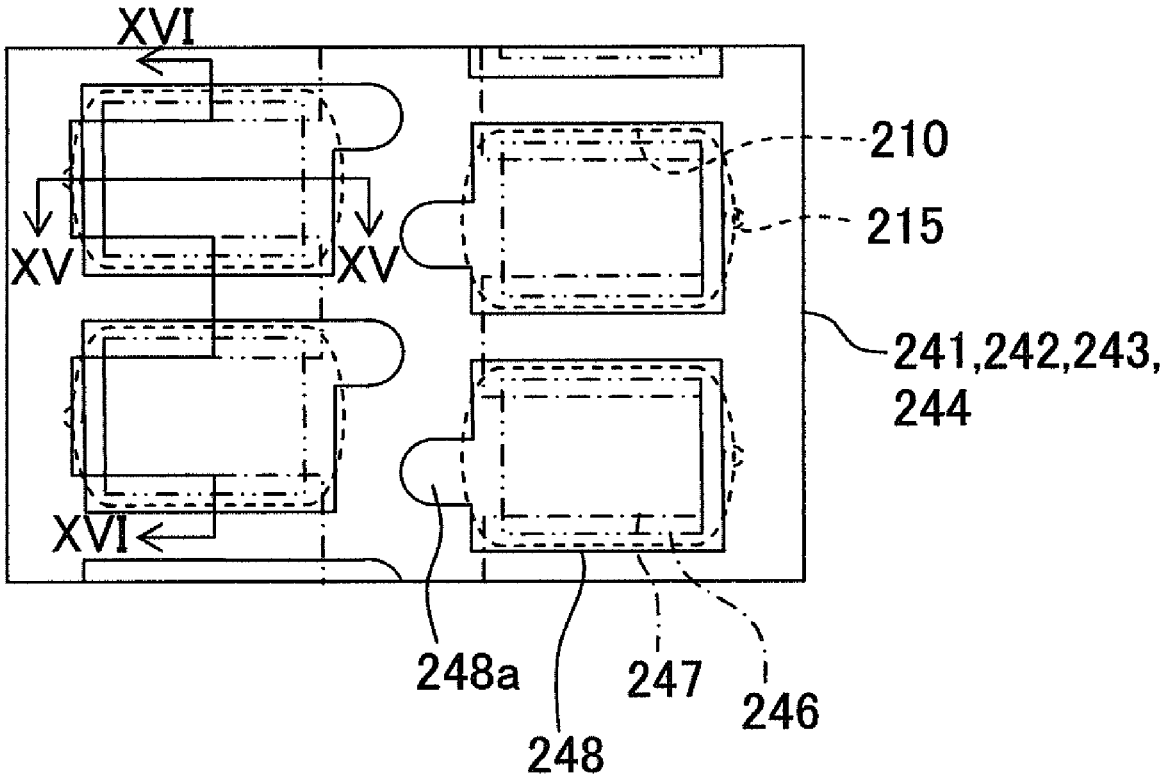
FIG. 13 is a partially enlarged view of FIG. 12.
Figure 14C:
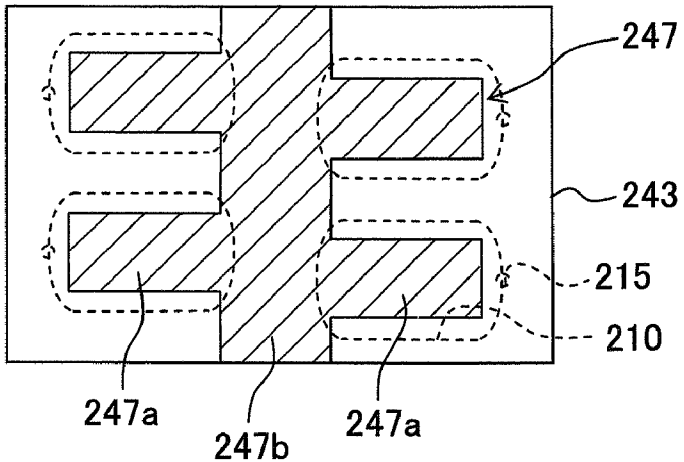
FIGS. 14A to 14D are diagrams showing upper surfaces of an upper piezoelectric layer, an intermediate piezoelectric layer, a lower piezoelectric layer, and a vibration plate, respectively.
Figure 14D:
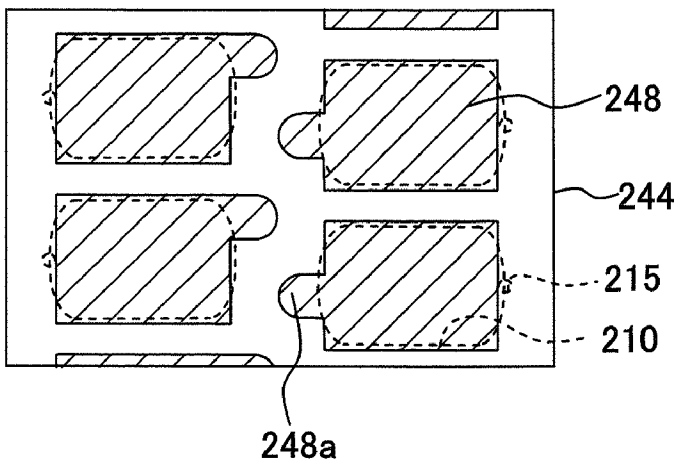
Figure 14A:
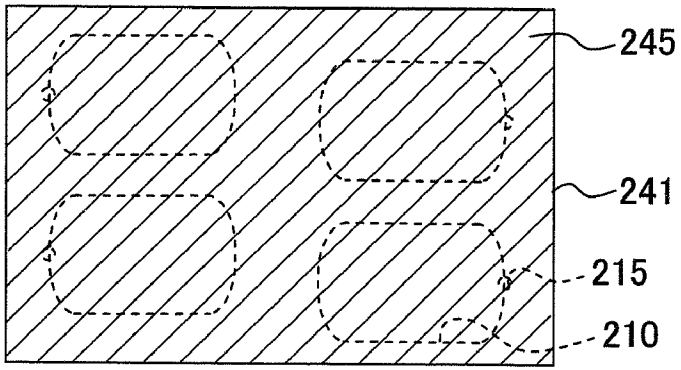
Figure 14B:
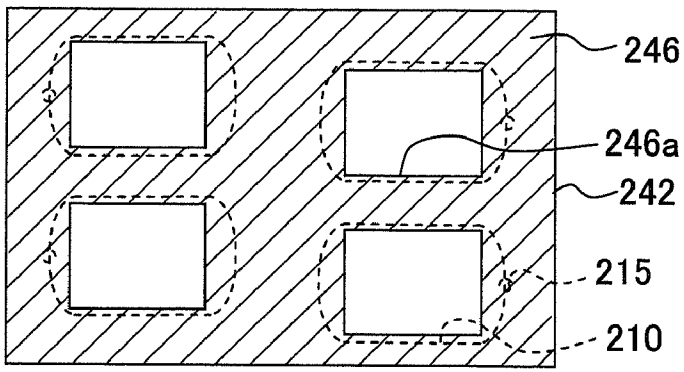
Figure 15:
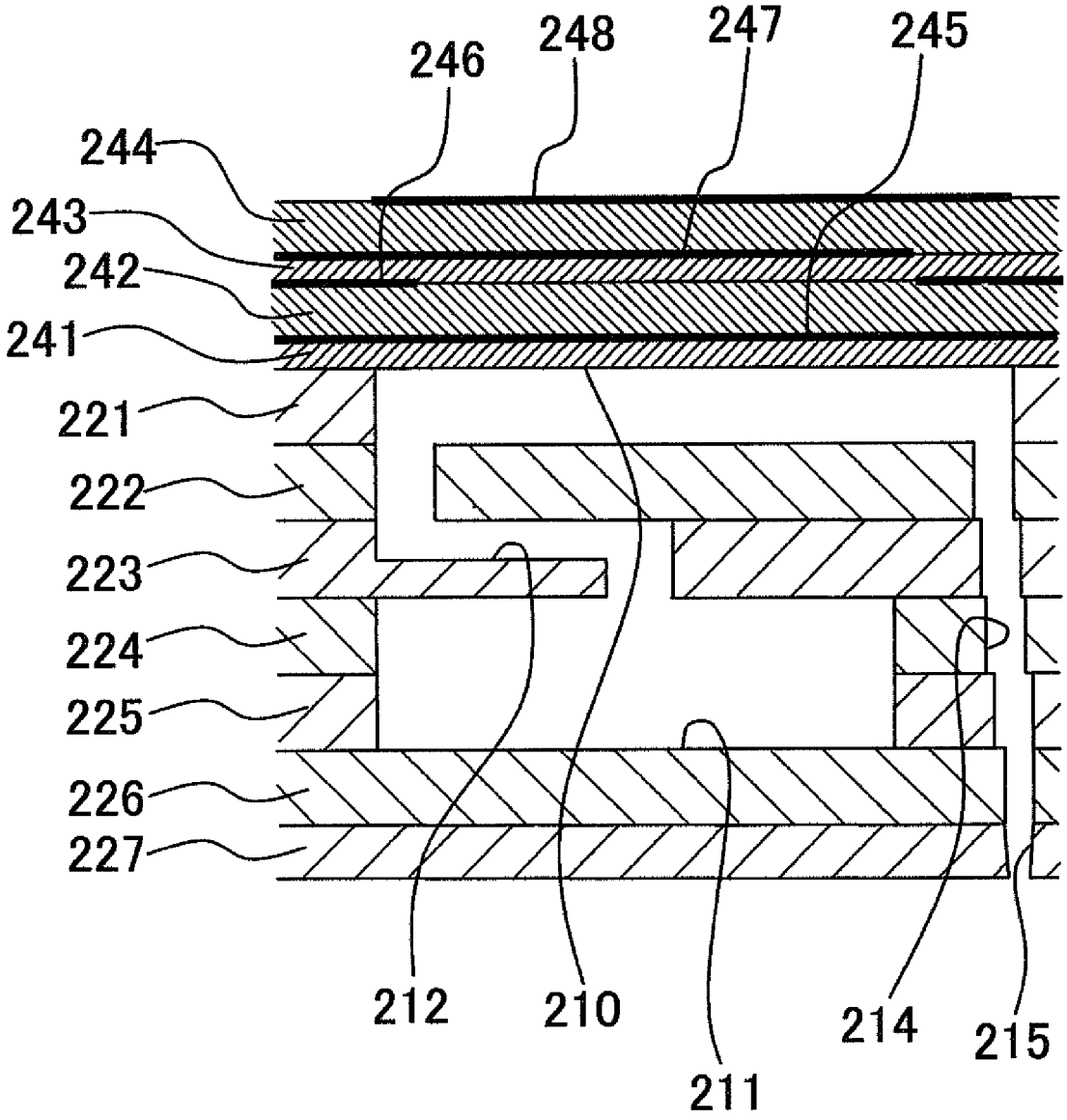
FIG. 15 is a cross-sectional view taken along a line XV-XV in FIG. 13.

FIG. 12 is a plan view of the ink-jet head according to the second embodiment. FIG. 13 is a partially enlarged view of FIG. 12. FIG. 14A to FIG. 14D are diagrams in which an upper surface of a piezoelectric layers 242, 243, and 244, and a vibration plate 241 which will be described later are shown. FIG. 15 is a cross-sectional view taken along a line XV-XV in FIG. 13. FIG. 6 is a cross-sectional view taken along a line XVI-XVI in FIG. 13.

For making the diagrams easily understandable, in diagrams from FIG. 12 to FIG. 14, ink channels, of a channel unit 231 which will be described later, excluding pressure chambers 210 and nozzles 215 are omitted, and in FIG. 12, electrodes 245, 246, and 247 of a piezoelectric actuator 232 are omitted. Moreover, in FIG. 13, the electrodes 246 and 247 which are to be indicated by dotted lines are indicated by alternate long and two short dashes line and alternate long and short dash lines respectively. Furthermore, in FIG. 14, electrodes 243, 244, and 245 which will be described later are hatched. Moreover, in FIG. 16, a portion of the channel unit 231 below the pressure chamber 210 is omitted.

An ink-jet head 203 according to the second embodiment, similarly as the ink-jet head 3 (refer to FIG. 1) according to the first embodiment, is also a head used in the printer 1 (refer to FIG. 1). As shown in diagrams from FIG. 12 to FIG. 16, the ink-jet head 203 includes the channel unit 231 and the piezoelectric actuator 232. In the channel unit 231, by the plurality of plates 221 to 227 being stacked mutually, ink channels (liquid transporting channels) having a manifold channel 211 to which the ink is supplied from an ink supply port 209, and a plurality of individual ink channels each from an outlet of the manifold channel 211 reaching up to one of the pressure chambers 210 via one of the aperture channels 212, and further from the pressure chamber 210 up to one of the nozzles 215 via one of the descender channels 214 are formed. Moreover, as it will be described later, when a pressure is applied to the ink in the pressure chamber 210 by the piezoelectric actuator 232, the ink is jetted from the nozzle 215 communicating with the pressure chamber 210.

From among the plates 221 to 227, the six plates 221 to 226 excluding the plate 227 in which the nozzles 215 are formed are formed of a metallic material, having a coefficient of linear expansion greater than a coefficient of linear expansion of a piezoelectric material which forms the piezoelectric layers 242 to 244 and the vibration plate 241 which will be described later, such as a stainless steel, for example, SUS 430 (coefficient of linear expansion of about 10.4 [$10^{-6}$/° C.]) and SUS 316 (coefficient of linear expansion of about 16.0 [$10^{-6}$/° C.]), and the plate 227 is made of a synthetic resin material such as polyimide. Or, the plate 227 may also be formed of a metallic material similarly as the plates 221 to 226.

Each of the pressure chambers 210 has a substantially elliptical planar shape with the scanning direction (left-right direction in FIG. 13) as a longitudinal direction, and the pressure chambers 210 are arranged along the paper feeding direction (up-down direction in FIG. 13), forming one pressure chamber row 208. By two pressure chamber rows 208 being arranged in the scanning direction, one pressure chamber group 207 is formed. Furthermore, five such pressure chamber groups 207 are arranged along the scanning direction. Here, the pressure chambers 210 forming the two pressure chamber rows 208 included in one pressure chamber group 207 are arranged to be shifted mutually in the paper feeding direction. Moreover, the nozzles 215 are also arranged similarly as the pressure chambers 210.

A black ink is jetted from the nozzles 215 corresponding to the pressure chambers 210 forming the two pressure chamber groups 207 on a right side in FIG. 12 out of the five pressure chamber groups 207. Inks of yellow, cyan, and magenta color are jetted in order from nozzles arranged on right side in FIG. 12, from the nozzles 215 corresponding to the pressure chambers 210 forming the three pressure chamber groups on a left side in FIG. 12. Since the remaining portions of the ink channel are similar as in the conventional ink channel, the detailed description thereof is omitted.

The piezoelectric actuator 232 includes the vibration plate 241, the piezoelectric layers 242 to 244, and the electrodes 245 to 248. The vibration plate 241 is made of a piezoelectric material (coefficient of linear expansion of about 5.5[$10^{-6}$/° C.]) having a coefficient of linear expansion smaller than a coefficient of linear expansion of the plates 221 to 226 which are constituted mainly by lead zirconium titanate which is a mixed crystal of lead titanate and lead zirconate. The vibration plate 241 is joined, by an adhesive such as a thermosetting adhesive, on an upper surface of the plate 221 forming the channel unit 231 to cover the pressure chambers 210.

The piezoelectric layers 242 to 244 are made of a piezoelectric material similar to the material of the vibration plate 241, and arranged on an upper surface of the vibration plate 241 upon being stacked mutually. More elaborately, the piezoelectric layer 242 (lower piezoelectric layer) is arranged on the upper surface of the vibration plate 241 (on a side opposite to the pressure chambers 210), the piezoelectric layer 243 (intermediate piezoelectric layer) is arranged on an upper surface of the piezoelectric layer 242 (on the side opposite to the pressure chamber 210), and the piezoelectric layer 244 (upper piezoelectric layer) is formed on an upper surface of the piezoelectric layer 243 (on the side opposite to the pressure chamber 210).

The electrode 247 is arranged between the piezoelectric layer 243 and the piezoelectric layer 244, and includes a plurality of facing portions 247*a* (first electrodes) and a plurality of connecting portions 247*b*. Each of the facing portions 247*a* extends in the scanning direction (left-right direction in FIG. 13), and is arranged to face (arranged face-to-face) a substantially central portion in the paper feeding direction (up-down direction in FIG. 13) of one of the pressure chambers 210. Portion of each of the connecting portions 247*b*, facing a portion between the adjacent pressure chamber groups 207 in a plan view extends in the paper feeding direction, and end portions of the facing portions 247*a* positioned at both sides of the scanning direction thereof are connected to the connecting portion 247*b*. The electrode 247 is connected to the driver IC 50 (refer to FIG. 6) via an FPC which is not shown in the diagram, and is kept at the ground electric potential all the time by the driver IC 50. Here, in the second embodiment, since the facing portions 247*a* are connected mutually by the connecting portions 247*b*, it is not necessary to connect the FPC to each of the facing portions 247*a* individually, and a wiring of the FPC becomes simple.

A plurality of electrodes 248 (second electrodes) are arranged corresponding to the plurality of pressure chambers 210, on an upper surface of the piezoelectric layer 244 (on a side opposite to the piezoelectric layer 243). Each of the electrodes 248 has a substantially rectangular planar shape, and is arranged to entirely face one of the pressure chambers 210. Accordingly, the electrode 248 faces the facing portion 247*a* at a substantially central portion thereof, and extends to an outer side of the facing portion 247*a* on both sides of the paper feeding direction (vertical direction in FIG. 14, a predetermined direction parallel to a planar direction of the piezoelectric layer). Moreover, apart of one end portion, (end portion at an opposite side of the nozzle 215) in the scanning direction, of the electrode 248 extends to a portion not facing the pressure chamber 210, in the scanning direction, and is a connecting terminal 248*a* to be connected to an FPC which is not shown in the diagram. Moreover, the electrode 248 is connected to the driver IC 50 via the FPC, and one of the ground electric potential and a predetermined electric potential (for example, about 20 V) is selectively applied.

The electrode 246 is arranged between the piezoelectric layer 242 and the piezoelectric layer 243 to spread over almost the entire area, and extracted patterns 246*a* are formed at portions each facing a substantially central portion of the pressure chamber 10. In the second embodiment, portions of the electrode 246 positioned at both sides of the extracted pattern 246*a* with respect to the paper feeding direction (portion facing a portion stuck out at an outer side of the facing portion 27*a* of the electrode 248) corresponds to the third electrode according to the present invention, and this portion of the electrode 246 sandwiches the facing portion 247*a*, when viewed from a direction of stacking of the piezoelectric layers 242 to 244, and the vibration plate 241.

In this manner, in the second embodiment, by arranging the electrode 246 to spread over almost the entire portion between the piezoelectric layer 242 and the piezoelectric layer 243, and by forming the extracted pattern 246*a* in the electrode 246, it is possible to form easily a plurality of third electrodes which are connected mutually. Moreover, the electrode 246 is connected to the driver IC 50 via an FPC which is not shown in the diagram, and is kept all the time at a predetermined electric potential (for example, 20 V) which is different from the ground electric potential, by the driver IC 50. At this time, the electrode 246 is integrated by the plurality of third electrodes according to the present invention being connected mutually, it is not necessary to connect a wire of the FPC separately for each of the third electrodes, and a wiring of the FPC becomes simple.

The electrode 245 is arranged between the vibration plate 241 and the piezoelectric layer 242 (on a side opposite to the piezoelectric layer 243 with respect to the piezoelectric layer 242), to spread over almost the entire area. In the second embodiment, portions of the electrode 245, facing the portions of the electrode 246 corresponding to the third electrodes, corresponds to the fourth electrode according to the present invention. Moreover, by arranging the electrode 245 between the vibration plate 241 and the piezoelectric layer 242, to spread over almost the entire area thereof, it is possible to form easily the plurality of fourth electrodes which are connected mutually. The electrode 245 is connected to the driver IC 50 via an FPC which is not shown in the diagram, and is kept all the time at the ground electric potential by the driver IC 50. At this time, since the electrode 245 is integrated by the plurality of fourth electrodes according to the present invention being connected mutually, it is not necessary to connect a wire of the FPC separately for each of the fourth electrodes, and a wiring of the FPC becomes simple.

Moreover, in the piezoelectric actuator 232, a portion (an active portion R1) of the piezoelectric layer 244 sandwiched between each of the facing portions 247*a* and one of the electrodes 248 is polarized downward in a thickness direction thereof, and portions (an active portion R2) of the piezoelectric layers 243 and 244 sandwiched between each of the electrodes 246 and one of the electrodes 248 is polarized upward in the thickness direction thereof. Furthermore, a portion (contraction-distortion reducing portion R3) of the piezoelectric layer 242, sandwiched between the electrode 245 and each of the electrode 246 is polarized downward in a thickness direction thereof.

Next, an operation of the piezoelectric actuator 232 will be described below. In a stand-by state before the piezoelectric actuator 232 makes jet the ink from the nozzles 215, as it has been described above, the electrodes 245 and 247 are kept at the ground electric potential, and the electrode 246 is kept at the predetermined electric potential (for example, 20 V) all the time, and an electric potential of the plurality of electrodes 248 is kept at the predetermined electric potential in advance. In this state, each of the electrode 248 is at an electric potential greater than an electric potential of the electrode 247, and the electrode 248 and the electrode 246 are at the same electric potential.

Accordingly, an electric potential difference is developed between the electrode 248 and the electrode 247, and an electric field in a direction same as the polarization direction is generated in the active portion R1. Accordingly, the active portion R1 contracts in a planar direction orthogonal to the electric field. Accordingly, a so-called unimolf deformation occurs, and portions, facing the pressure chamber 210, of the vibration plate 241 and the piezoelectric layers 242 to 244 as a whole are deformed to form a projection toward the pressure chamber 210. In this state, a volume of the pressure chamber 210 is small as compared to a volume in a state in which the piezoelectric layers 242 to 244 and the vibration plate 241 are not deformed.

Further, at the time of driving the piezoelectric actuator 232 to make jet the ink, the electric potential of the electrode 248 corresponding to the nozzle 215 which jets the ink is switched once to the ground electric potential, and after a predetermined time, is returned to the predetermined electric potential (to change the voltage to be applied between the first electrode and the second electrode). When the electric potential of the electrode 248 is switched to the ground electric potential, the electrode 248 is at the same electric potential as the electrode 247, and is at a lower electric potential than the electrode 246. Accordingly, the contraction of the active portion R1 returns to the original state, and at the same time, an electric potential difference is developed between the electrode 248 and the electrode 246. As a result, an electric field in an upward direction same as the polarization direction is generated in the active portion R2, and the active portion R2 contracts in a planar direction thereof. Accordingly, the piezoelectric layers 242 to 244 and the vibration plate 241 as a whole are deformed to form a projection toward an opposite side of the pressure chamber 210, and the volume of the pressure chamber 210 increases.

Thereafter, when the electric potential of the electrode 248 is returned to the predetermined electric potential, similarly as it has been described above, the portions of the piezoelectric layers 242 to 244 and the vibration plate 241 facing the pressure chamber 210 are deformed as a whole forming a projection toward the pressure chamber 210. Accordingly, a pressure of the ink in the pressure chamber 210 is increased (a pressure is applied to the ink in the pressure chamber 210), and the ink is jetted from the nozzle 215 communicating with the pressure chamber 210.

Moreover, in a case of driving the piezoelectric actuator 232 as described above, when the electric potential of the electrode 248 is switched from the predetermined electric potential to the ground electric potential, the active portion R1 elongates from a state of being contracted to a state before getting contracted, and the active portion R2 contracts. Therefore, a part of the elongation of the active portion R1 is absorbed in the contraction of the active portion R2. On the other hand, when the electric potential of the electrode 248 is returned from the ground electric potential to the predetermined electric potential, since the active portion R1 contracts and the active portion R2 elongates to the state before getting contracted, a part of the contraction of the active portion R1 is absorbed by the elongation of the active portion R2.

From the description made above, a so-called cross-talk in which the deformation of portions, of the piezoelectric layer 244 and the piezoelectric layer 243, facing the pressure chamber 210 are propagated to portions of the piezoelectric layer 244 and the piezoelectric layer 243, facing the other pressure chamber 210, and jetting characteristics of the ink from the nozzle 215 communicating with the other pressure chamber 210 are fluctuated, is suppressed.

Here, as it has been described above, at the time of joining the vibration plate 241 and the channel unit 231 (plate 221) by a thermosetting adhesive, the vibration plate 241 and the channel unit 231 are to be heated. Since the plate 221 in the channel unit 231 is made of a material having a coefficient of linear expansion greater than the coefficient of linear expansion of the vibration plate 241 and the piezoelectric layers 242 to 244, when the plate 221 returns to the room temperature after the heating, due to the difference in the coefficient of linear expansion of the plate 221 and the coefficient of linear expansion of the vibration plate 241 and the piezoelectric layers 242 to 244, a contraction distortion in a planar direction thereof occurs. Moreover, when such contraction distortion occurs in the piezoelectric layers 242 to 244, an amount of deformation of the active portions R1 and R2 when the piezoelectric actuator 232 is driven as described above becomes small, and there is a possibility that the jetting characteristics of the ink from the nozzle 215 are declined.

However, in the second embodiment, the piezoelectric layer 242 is polarized downward in the thickness direction in the contraction-distortion reducing portion R3, and during the abovementioned stand-by state, and at the time of jetting the ink from the nozzle 215 (at least while the pressure applying operation (deformation operation) is being carried out), the electrode 245 is maintained at the ground electric potential, and the electrode 246 is maintained at the predetermined electric potential all the time. Since a constant voltage is continuously applied between the electrode 245 and the electrode 246, an electric field in a downward direction of the thickness direction which is same as the direction of polarization is generated. Accordingly, the contraction-distortion reducing portion R3 is contracted in a planar direction thereof.

Due to this contraction, the portion, of the piezoelectric layer 242, facing the pressure chamber 210 is pulled toward an outer side of the pressure chamber 210 together with the portions, of the piezoelectric layers 243 and 244 joined to the upper surface of the piezoelectric layer 242, facing the pressure chamber 210, and the contraction distortion of the active portion R1 is reduced. Accordingly, the decline in an amount of deformation of the active portion R1 when the piezoelectric actuator 232 is driven is suppressed.

According to the second embodiment described above, the piezoelectric layer 242 is polarized downward in the thickness direction in the contraction-distortion reducing portion R3. The electrode 245 is kept at the ground electric potential and the electrode 246 is kept at the predetermined electric potential all the time. Therefore, the electric field in the downward direction of the thickness direction, which is same as the polarization direction is generated in the contraction-distortion reducing portion R3 due to the electric potential difference between the electrode 245 and the electrode 246, and the contraction-distortion reducing portion R3 is contracted in the planar direction thereof.

Moreover, since the plurality of facing portions 247*a* are connected mutually by the connecting portion 247*b*, it is not necessary to connect the FPC separately to each of the facing portions 247*a*, and it is possible to simplify the wiring of the FPC.

Moreover, since the electrode 246 which is integrated by the plurality of third electrodes being connected mutually is formed between the piezoelectric layer 242 and the piezoelectric layer 243, it is not necessary to connect the wires of the FPC separately to each of the third electrodes, and the wiring of the FPC becomes simple.

Moreover, since the electrode 245 which is integrated by the plurality of fourth electrodes being connected mutually between the vibration plate 241 and the piezoelectric layer 242, it is not necessary to connect the wires of the FPC separately to each of the fourth electrodes, and the wiring of the FPC becomes simple.

Next, modified embodiments in which various modifications are made in the second embodiment will be described below. However, same reference numerals are assigned to components having a structure similar as in the second embodiment, and the description of such components is omitted.

Figure 17:
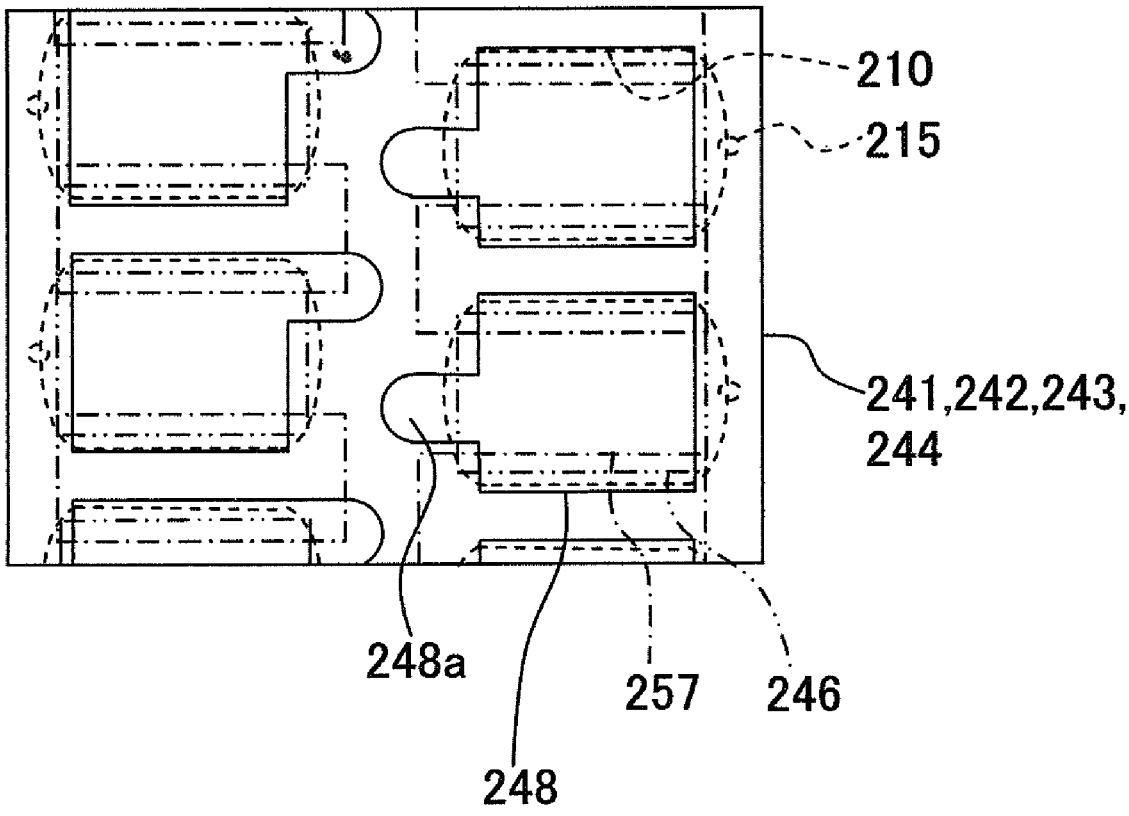
FIG. 17 is a diagram of a fifth modified embodiment, corresponding to FIG. 13.
Figure 18C:
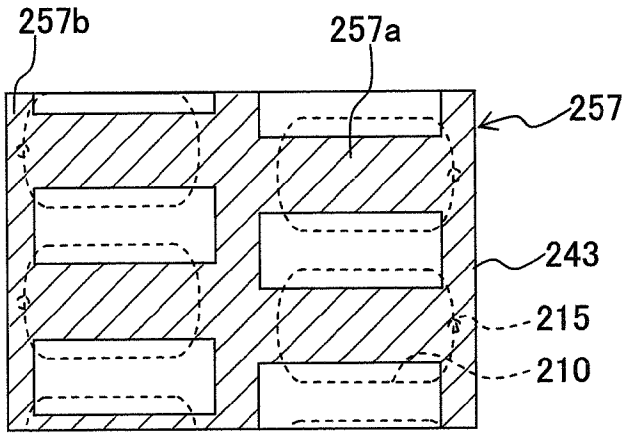
FIGS. 18A to 18D are diagrams of the fifth modified embodiment, corresponding to FIGS. 14A to 14D.
Figure 18D:
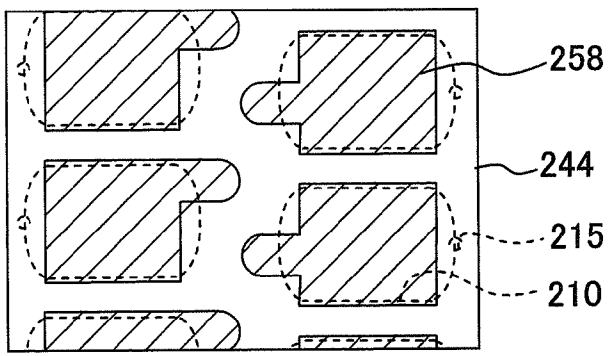
Figure 18A:
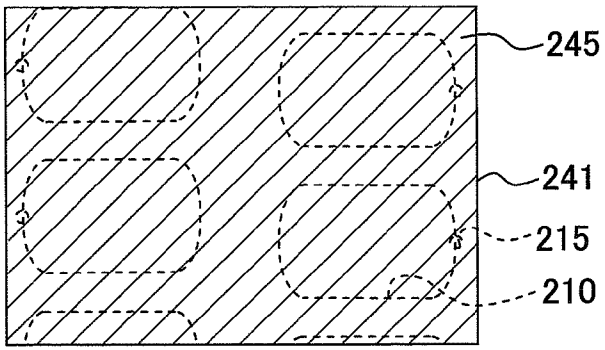
Figure 18B:
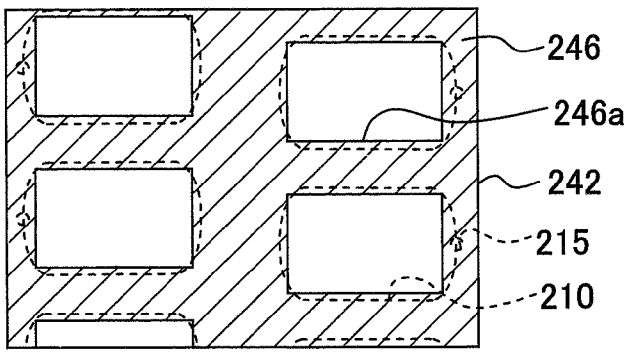

In a fifth modified embodiment, as shown in FIG. 17 and FIG. 18, instead of the electrode 247 (refer to FIG. 14), an electrode 257 is arranged between the piezoelectric layer 243 and the piezoelectric layer 244. The electrode 257 has a plurality of facing portions 257*a* and a plurality of connecting portions 257*b*. Each of the facing portions 257*a*, similarly as the facing portion 247*a* (refer to FIG. 14) extends in the scanning direction (left-right direction in FIG. 17), and is arranged to face the substantially central portion, of one of the pressure chambers 210, in the paper feeding direction (up-down direction in FIG. 17). Each of the plurality of connecting portions 257*b* extends in the paper feeding direction at a portion facing a portion between all the adjacent pressure chamber rows 208, and the facing portions 257*a* which are arranged on both sides in the scanning direction are connected to the connecting portion 257*b*.

Figure 16:
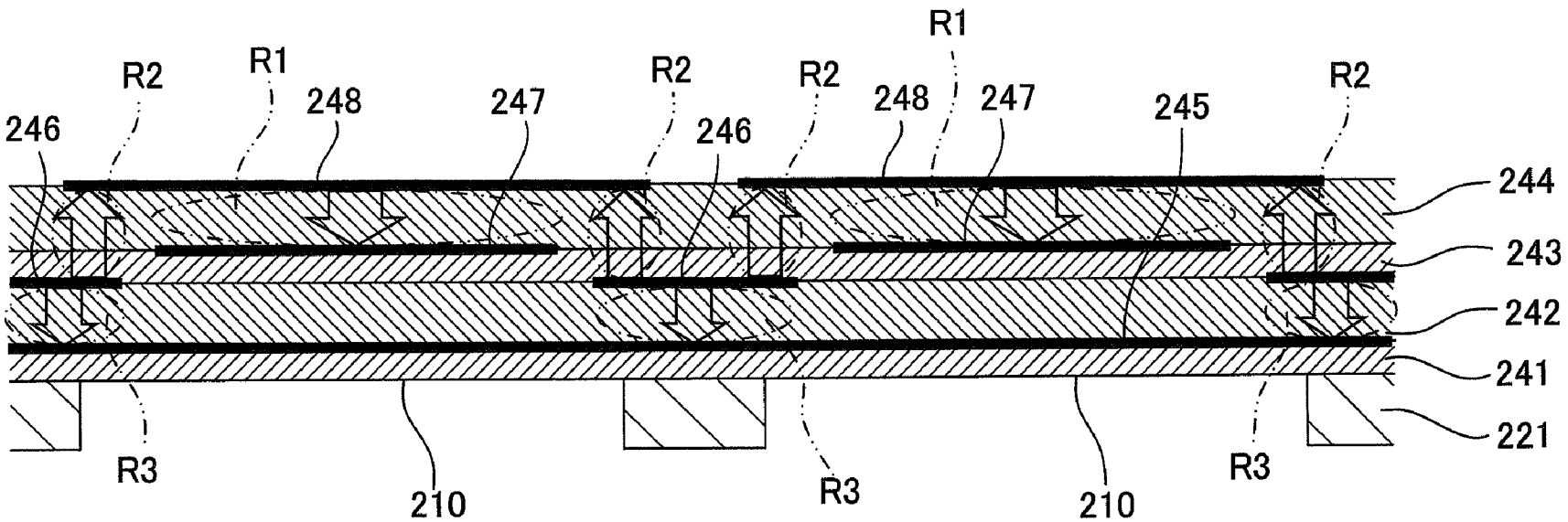
FIG. 16 is a cross-sectional view taken along a line XVI-XVI in FIG. 13.

Even in this case, a cross-section corresponding to FIG. 16 is similar to the case in the second embodiment (a reference numeral 247 in FIG. 16 is changed to a reference numeral 257), and it is possible to drive similarly as the ink-jet head in the second embodiment. Furthermore, similarly as in the second embodiment, it is possible to reduce the contraction distortion of the active portion R1 by the contraction-distortion reducing portion R3 being contracted in the planar direction.

Figure 19:
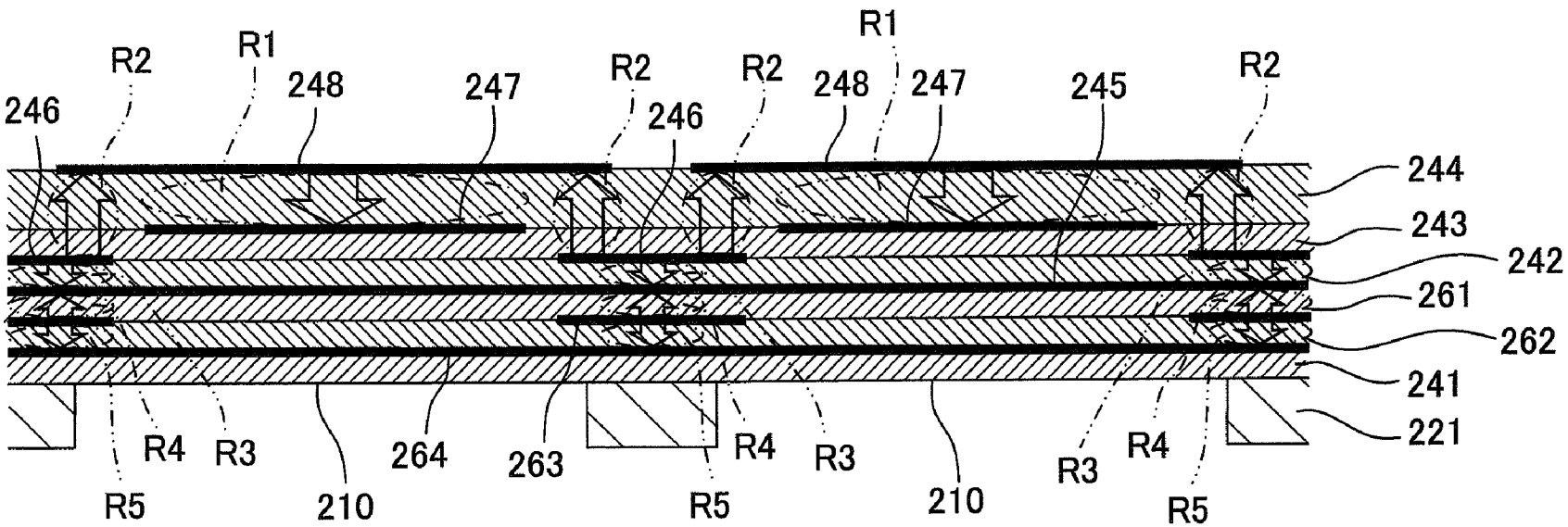
FIG. 19 is a diagram of a sixth modified embodiment, corresponding to FIG. 16.

In a sixth modified embodiment, as shown in FIG. 19, a thickness of the piezoelectric layer 242 is less than in a case in the second embodiment, and two piezoelectric layers 261 and 262 having a thickness almost same as the thickness of the piezoelectric layer 242 are stacked between the piezoelectric layer 242 and the vibration plate 241. Moreover, an electrode 263 (third electrode) having an almost same planar shape as the electrode 246, and being kept at the predetermined electric potential all the time is arranged between the piezoelectric layer 261 and the piezoelectric layer 262, and an electrode 264 (fourth electrode) having an almost same planar shape as the electrode 245 and being kept at the ground electric potential all the time is arranged between the piezoelectric layer 262 and the vibration plate 241. In other words, the third electrodes (electrodes 246 and 263) and the fourth electrodes (electrodes 245 and 264) are arranged alternately in the stacking direction, on a surface of some of the piezoelectric layers (piezoelectric layers 242, 261, and 262) out of the plurality of piezoelectric layers 242 to 244, and 261 and 262. Furthermore, a portion of the piezoelectric layer 261 sandwiched between the electrode 245 and the electrode 263 (contraction-distortion reducing portion R4) is polarized upward in a thickness direction thereof, and a portion of the piezoelectric layer 262, sandwiched between the electrode 263 and the electrode 264 (contraction-distortion reducing portion R5) is polarized downward in a thickness direction thereof.

In this case, similarly as in the second embodiment, in addition to the contraction-distortion reducing portion R3 being contracted in a planar direction thereof due to an electric field generated by a constant voltage being applied between the electrode 245 and the electrode 246, the contraction-distortion reducing portion R4 contracts in a planar direction thereof due to an electric field generated by a constant voltage being applied between the electrode 245 and the electrode 263, and the contraction-distortion reducing portion R5 contracts in a planar direction thereof due to an electric field generated by a constant voltage being applied between the electrode 263 and the electrode 264.

Accordingly, similarly as in the case in the second embodiment, the contraction distortion of the active portion R1 is reduced, and a decrease in the amount of deformation of the active portion R1 when the piezoelectric actuator 232 is driven is suppressed. Furthermore, in the sixth modified embodiment, a thickness of the piezoelectric layers 242, 261, and 262 being less than the thickness of the piezoelectric layer 242 in the case in the second embodiment, the electric field generated in the contraction-distortion reducing portions R3 to R5 becomes substantial, and an amount of contraction of the contraction-distortion reducing portions R3 to R5 also becomes substantial. Consequently, it is possible to reduce efficiently the contraction distortion of the active portion R1.

Moreover, even in the second embodiment, similarly as in the first modified embodiment described above, the vibration plate 241 may be formed of an electroconductive material having a coefficient of linear expansion higher than the coefficient of linear expansion of a piezoelectric material, such as SUS 430 and SUS 316, and the vibration plate 241 may also serve as the electrode 245.

Examples in which, the present invention is applied to an ink-jet head which jets an ink from the nozzles have been described above. However, the present invention is also applicable to a liquid transporting apparatus which jets a liquid or which transports a liquid other than ink. Furthermore, the present invention is also applicable to a piezoelectric actuator which drives a drive portion of various apparatuses.

What is claimed is:

1. A liquid transporting apparatus which transports a liquid, comprising:

a channel unit in which liquid transporting channel transporting the liquid is formed, the liquid transporting channel including a pressure chamber;

a piezoelectric actuator which is connected to the channel unit, and which applies a pressure to the liquid in the pressure chamber, the piezoelectric actuator having: a piezoelectric layer; a first electrode which is arranged on a first surface of the piezoelectric layer to face the pressure chamber; a second electrode which is arranged, to face the first electrode, on a second surface of the piezoelectric layer different from the first surface; third electrodes which are arranged on the piezoelectric layer to sandwich the first electrode in a plan view; and fourth electrodes which are arranged, to face the third electrode, on the piezoelectric layer;

a voltage applying mechanism which applies a voltage to the piezoelectric actuator; and a controller which controls the voltage applying mechanism, wherein the channel unit is formed of a material having a coefficient of linear expansion greater than a coefficient of linear expansion of the piezoelectric layer, and the voltage applying mechanism applies the voltage between the first electrode and the second electrode, and between the third electrodes and the fourth electrodes, and the controller controls the voltage applying mechanism so that the voltage applied between the first electrode and the second electrode is changed, and to thereby deform a portion of the piezoelectric layer facing the pressure chamber and to carry out a pressure applying operation to apply a pressure to the liquid in the pressure chamber and that a predetermined constant voltage is applied between the third electrodes and the fourth electrodes during the pressure applying operation.

2. The liquid transporting apparatus according to claim 1, further comprising a vibration plate which covers the pressure chambers of the channel unit, wherein the piezoelectric actuator is joined to the channel unit via the vibration plate.

3. The liquid transporting apparatus according to claim 2, wherein the vibration plate and the piezoelectric layer are formed of a same piezoelectric material.

4. The liquid transporting apparatus according to claim 2, wherein the vibration plate is formed of a material having a coefficient of linear expansion greater than the coefficient of linear expansion of the piezoelectric layer.

5. The liquid transporting apparatus according to claim 1, wherein the piezoelectric layer is polarized in a thickness direction of the piezoelectric layer.

6. The liquid transporting apparatus according to claim 5, wherein the pressure chamber is formed as a plurality of pressure chambers, the first electrode, the second electrode, the third electrodes, and the fourth electrodes are formed corresponding to each of the pressure chambers; and at least one of the third electrodes and the fourth electrodes are mutually connected on the piezoelectric layer.

7. The liquid transporting apparatus according to claim 5, wherein the third electrodes are arranged to surround the first electrode in the plan view, and the fourth electrodes are arranged to surround the second electrode in the plan view.

8. The liquid transporting apparatus according to claim 5, wherein the controller controls the voltage applying mechanism based on an input of a liquid transporting instruction for transporting the liquid in the liquid transporting channel to start applying the constant voltage between the third electrodes and the fourth electrodes.

9. The liquid transporting apparatus according to claim 8, wherein the controller controls the voltage applying mechanism to apply the constant voltage between the third electrodes and the fourth electrodes to thereby make the portion of the piezoelectric layer between the third electrodes and the fourth electrodes contract in a direction orthogonal to the thickness direction of the piezoelectric layer.

10. The liquid transporting apparatus according to claim 1, wherein the third electrodes are arranged on the first surface of the piezoelectric layer, and the fourth electrodes are arranged on the second surface of the piezoelectric layer.

11. The liquid transporting apparatus according to claim 10, wherein the voltage applying mechanism always maintains, at a predetermined reference electric potential, one of the first and third electrodes and the second and fourth electrodes, and changes the electric potential of the other of the first and third electrodes and the second and fourth electrodes to apply the voltage between the first electrode and the second electrode and between the third electrodes and the fourth electrodes;

and the one of the first and third electrodes and the second and fourth electrodes are connected to each other on the piezoelectric layer.

12. The liquid transporting apparatus according to claim 1, wherein the piezoelectric layer includes a plurality of piezoelectric layers, the piezoelectric layers including a lower piezoelectric layer which is arranged on a side opposite to the pressure chamber with respect to the vibration plate; an intermediate piezoelectric layer which is arranged on the side opposite to the pressure chamber with respect to the lower piezoelectric layer; and an upper piezoelectric layer which is arranged on the side opposite to the pressure chamber with respect to the intermediate piezoelectric layer;

the first electrode being arranged between the intermediate piezoelectric layer and the upper piezoelectric layer to face a central portion of the pressure chamber;

the second electrode is arranged on a surface, of the upper piezoelectric layer, not facing the intermediate piezoelectric layer to face the first electrode and the second electrode extends on both sides in a predetermined direction parallel to a planar direction of the piezoelectric layers, so that both end portions of the second electrodes are extended to locations corresponding to outside of the first electrode in a plan view;

the third electrodes are arranged between the lower piezoelectric layer and the intermediate piezoelectric layer to face the end portions of the second electrode which extends to the locations corresponding to the outside of the first electrode respectively;

the fourth electrodes are arranged on a surface, of the lower piezoelectric layer, not facing the intermediate piezoelectric layer to face the third electrodes respectively; and the pressure applying operation is carried out when the controller controls the voltage applying mechanism to switch the electric potential of the second electrode between a predetermined first electric potential and a predetermined second electric potential different from the first electric potential while maintaining the first and the fourth electrodes at the first electric potential and maintaining the third electrodes at the second electric potential.

13. The liquid transporting apparatus according to claim 1, wherein the piezoelectric layer includes a plurality of piezoelectric layers; and the third electrodes and the fourth electrodes are alternately arranged, on surfaces of a part of the plurality of piezoelectric layers, in a stacking direction of the piezoelectric layers.

14. A piezoelectric actuator comprising:

a vibration plate having a deformable portion which is formed to be deformable;

a piezoelectric layer arranged on one surface of the vibration plate;

a first electrode which is arranged on a first surface, of the piezoelectric layer, to face the deformable portion;

a second electrode which is arranged, to face the first electrode, on a second surface of the piezoelectric layer different from the first surface;

third electrodes which are arranged on the piezoelectric layer, at positions at which the third electrodes sandwich the first electrode as seen from a stacking direction of the vibration plate and the piezoelectric layer; and fourth electrodes which are arranged, to face the third electrodes respectively, on the piezoelectric layer, wherein the vibration plate is formed of a material having a coefficient of linear expansion greater than a coefficient of linear expansion of the piezoelectric layer; and a voltage applied between the first electrode and the second electrode is changed to carry out a deformation operation for deforming a portion of the piezoelectric layer and a portion of the vibration plate which face the deformable portion, and a predetermined constant voltage is applied between the third electrodes and the fourth electrodes during the deformable operation.

15. The piezoelectric actuator according to claim 14, wherein the piezoelectric layer is polarized in a thickness direction of the piezoelectric layer.

16. The piezoelectric actuator according to claim 15, wherein the piezoelectric layer includes a plurality of piezoelectric layers, the third electrodes are arranged on a surface of one of the piezoelectric layers, and the fourth electrodes are arranged on a surface, of the piezoelectric layers, different from the surface on which the third electrodes are arranged.

* * * * *